US007163035B2

(12) United States Patent
Khan et al.

(10) Patent No.: US 7,163,035 B2
(45) Date of Patent: Jan. 16, 2007

(54) AUTOMATED USE OF A VISION SYSTEM TO DETECT FOREIGN MATTER IN RECONSTITUTED DRUGS BEFORE TRANSFER TO A SYRINGE

(75) Inventors: Wahid Khan, Lindenhurst, IL (US); Abdolhosein Nasiri, Ormond Beach, FL (US)

(73) Assignee: ForHealth Technologies, Inc., Daytona Beach, FL (US)

( * ) Notice: Subject to any disclaimer, the term of this patent is extended or adjusted under 35 U.S.C. 154(b) by 287 days.

(21) Appl. No.: 10/846,959

(22) Filed: May 13, 2004

(65) Prior Publication Data

US 2005/0252572 A1 Nov. 17, 2005

(51) Int. Cl.
*B65B 1/30* (2006.01)

(52) U.S. Cl. ..... 141/94; 141/2; 141/27; 141/83; 604/407

(58) Field of Classification Search ..... 141/2, 141/7, 9, 21–27, 83, 94, 100–105, 234, 247; 604/407

See application file for complete search history.

(56) References Cited

U.S. PATENT DOCUMENTS

| | | | | |
|---|---|---|---|---|
| 2,880,723 A | | 4/1959 | Adams | |
| 2,981,432 A | | 4/1961 | Flood | |
| 3,527,017 A | | 9/1970 | Taylor et al. | |
| 3,736,933 A | | 6/1973 | Szabo | |
| 3,807,467 A | * | 4/1974 | Tascher et al. | 141/375 |
| 3,835,897 A | | 9/1974 | Gess | |
| 3,865,236 A | | 2/1975 | Rycroft | |
| 3,880,211 A | | 4/1975 | Gess | |
| 4,501,306 A | * | 2/1985 | Chu et al. | 141/94 |
| 4,535,820 A | | 8/1985 | Raines | |
| 4,624,148 A | | 11/1986 | Averette | |
| 4,683,916 A | | 8/1987 | Raines | |

(Continued)

FOREIGN PATENT DOCUMENTS

JP 2002340808 A * 11/2002

OTHER PUBLICATIONS

B. Braun Medical Inc., product descriptions from on-line catalog, 3-pages.

(Continued)

*Primary Examiner*—Timothy L. Maust
(74) *Attorney, Agent, or Firm*—Darby & Darby

(57) ABSTRACT

In one exemplary embodiment, an automated medication preparation system including automated syringe preparation that involves reconstitution of the medication is provided. The system includes: an automated device for delivering a prescribed unit dose of medication to the syringe by delivering the medication through the uncapped barrel. One exemplary automated device for delivering a prescribed unit dose of medication to the syringe is in the form of an automated device having a fluid delivery device that is movable in at least one direction. The fluid delivery device is adapted to perform the following operations: (1) receiving and discharging diluent from a diluent supply in a prescribed amount to reconstitute the medication in a drug vial; and (2) aspirating and later discharging reconstituted medication from the drug vial into the syringe. The system further includes a sensor for detecting any foreign matter (e.g., undissolved drug, pieces of septum, etc.) present in the reconstituted unit dose of drug prior to transfer of the reconstituted drug (unit dose) to the syringe.

31 Claims, 10 Drawing Sheets

U.S. PATENT DOCUMENTS

| | | | | |
|---|---|---|---|---|
| 5,256,154 | A | | 10/1993 | Liebert et al. |
| 5,341,854 | A | | 8/1994 | Zezulka et al. |
| 5,356,393 | A | | 10/1994 | Haber et al. |
| 5,597,530 | A | | 1/1997 | Smith et al. |
| 5,651,775 | A | | 7/1997 | Walker et al. |
| 5,704,921 | A | | 1/1998 | Carilli |
| 5,805,454 | A | | 9/1998 | Valerino |
| 5,899,889 | A | | 5/1999 | Futagawa et al. |
| 5,911,252 | A | * | 6/1999 | Cassel ..... 141/234 |
| 6,027,472 | A | | 2/2000 | Kriesel et al. |
| 6,048,086 | A | | 4/2000 | Valerino |
| 2002/0020459 | A1 | | 2/2002 | Baldwin |
| 2002/0198738 | A1 | | 12/2002 | Osborne |
| 2004/0088951 | A1 | | 5/2004 | Baldwin |

OTHER PUBLICATIONS

U.S. Appl. No. 10/426,910, Osborne et al.
U.S. Appl. No. 10/728,363, Osborne et al.
U.S. Appl. No. 10/728,371, Osborne et al.
U.S. Appl. No. 10/728,364, Osborne et al.
U.S. Appl. No. 10/921,268, Dennis Tribble.

* cited by examiner

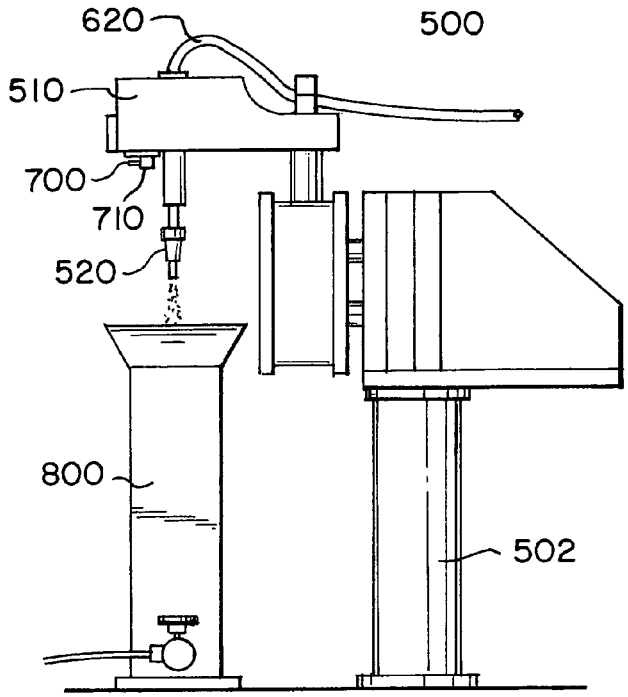
FIG. 13
FIG. 14
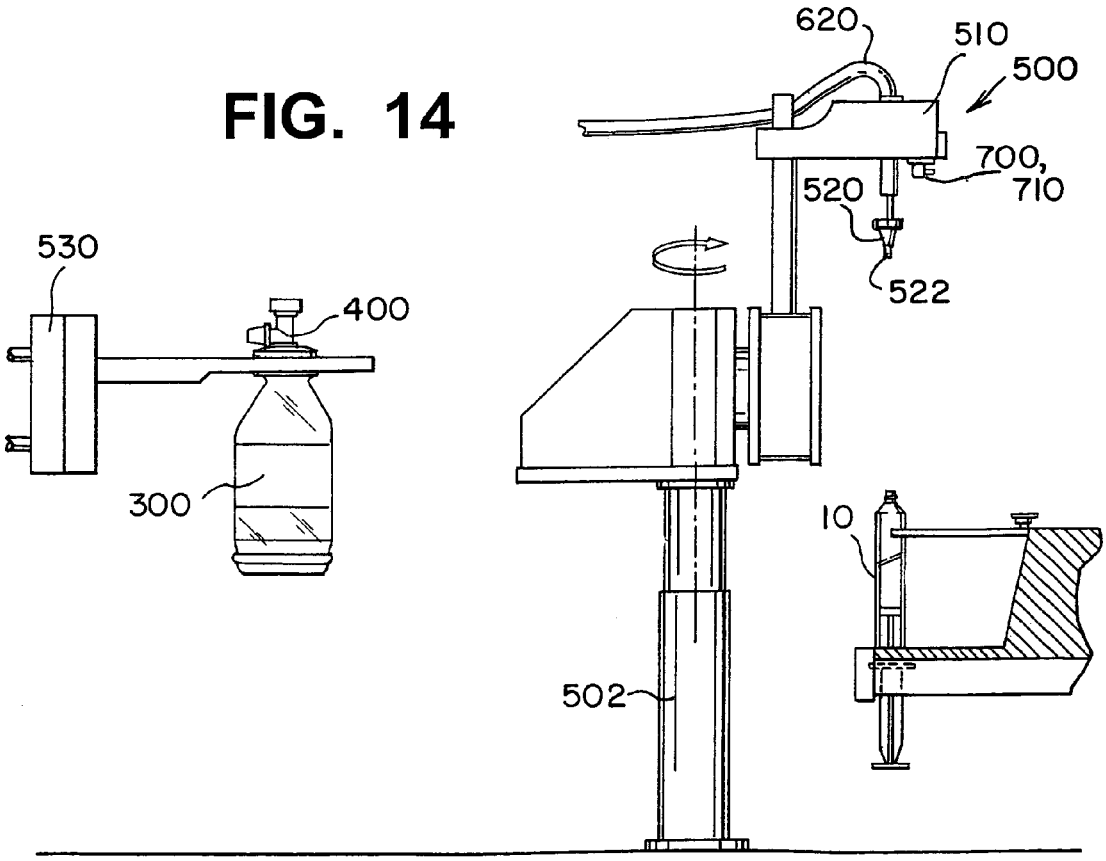

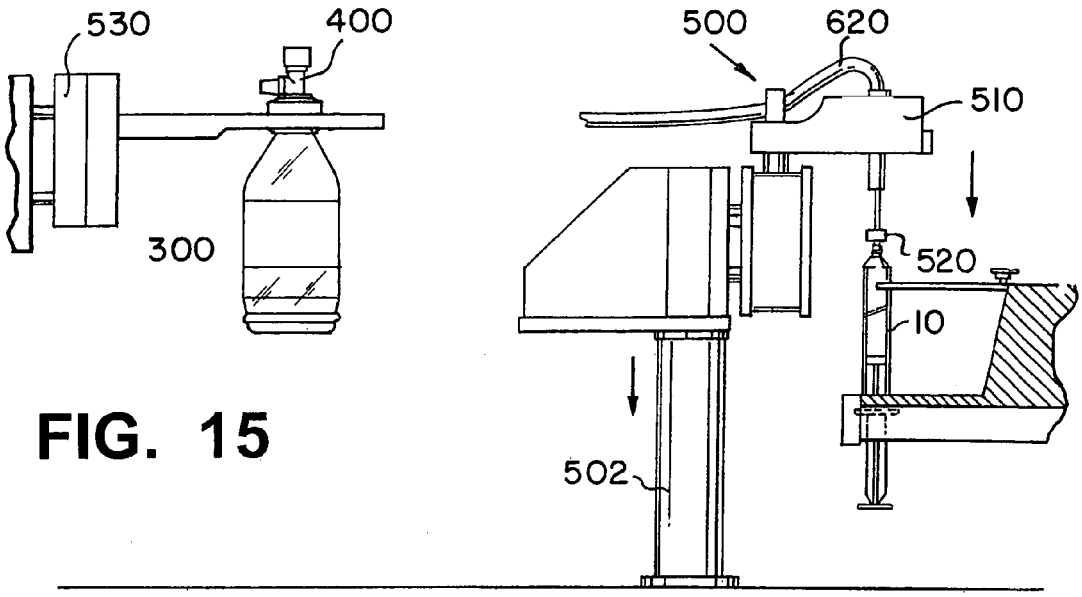
FIG. 15
FIG. 16
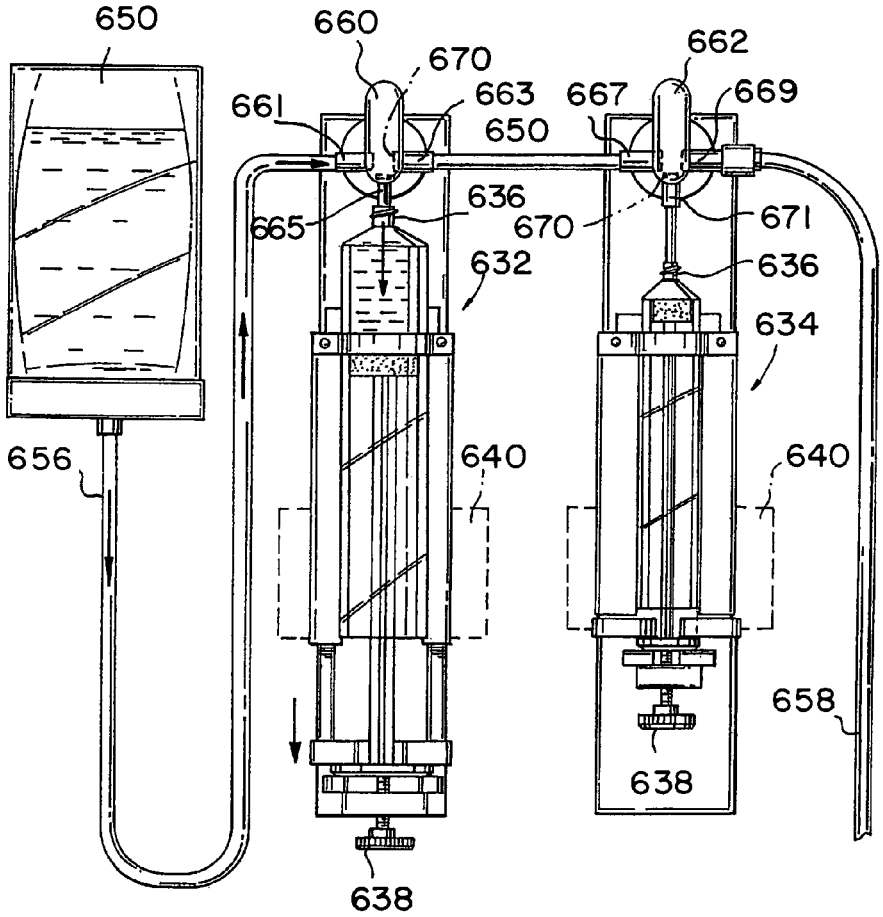

AUTOMATED USE OF A VISION SYSTEM TO DETECT FOREIGN MATTER IN RECONSTITUTED DRUGS BEFORE TRANSFER TO A SYRINGE

TECHNICAL FIELD

The present invention relates generally to medical and pharmaceutical equipment, and more particularly, to an automated syringe preparation that includes reconstitution of the medication and delivery of the reconstituted medication to a syringe for detecting and has at least one sensor incorporated therein for detecting undesirable foreign matter that may have been introduced into a fluid conduit associated with the system.

BACKGROUND

Disposable syringes are in widespread use for a number of different types of applications. For example, syringes are used not only to withdraw a fluid (e.g., blood) from a patient but also to administer a medication to a patient. In the latter, a cap or the like is removed from the syringe and a unit dose of the medication is carefully measured and then injected or otherwise disposed within the syringe.

As technology advances, more and more sophisticated, automated systems are being developed for preparing and delivering medications by integrating a number of different stations, with one or more specific tasks being performed at each station. For example, one type of exemplary automated system operates as a syringe filling apparatus that receives user inputted information, such as the type of medication, the volume of the medication and any mixing instructions, etc. The system then uses this inputted information to disperse the correct medication into the syringe up to the inputted volume.

In some instances, the medication that is to be delivered to the patient includes more than one pharmaceutical substance. For example, the medication can be a mixture of several components, such as several pharmaceutical substances.

By automating the medication preparation process, pharmacies achieve better accuracy, better cleanliness, and improved production and efficiency. This results in reduced production costs and also permits the system to operate over any time period of a given day with only limited operator intervention for manual inspection to ensure proper operation is being achieved. Such a system finds particular utility in settings, such as large hospitals, including a large number of doses of medications that must be prepared daily. Traditionally, these doses have been prepared manually in what is an exacting but tedious responsibility for a highly skilled staff. In order to be valuable, automated systems must maintain the exacting standards set by medical regulatory organizations, while at the same time simplifying the overall process and reducing the time necessary for preparing the medications.

Because syringes are used often as the carrier means for transporting and delivering the medication to the patient, it is advantageous for these automated systems to be tailored to accept syringes. However, the previous methods of dispersing the medication from the vial and into the syringe were very time consuming and labor intensive. More specifically, medications and the like are typically stored in a vial that is sealed with a safety cap or the like, under which is a penetrable membrane or septum. In conventional medication preparation, a trained person retrieves the correct vial from a storage cabinet or the like, confirms the contents and then removes the safety cap manually. This is typically done by simply popping the safety cap off with one's hands. Once the safety cap is removed, the trained person inspects the integrity of the septum and cleans the septum with a disinfectant, for example, 70% isopropyl alcohol. A sharp, hollow sterile instrument, e.g., a needle attached to a syringe, is then used to pierce the septum and withdraw the desired amount of medication from the vial into the syringe. The withdrawn medication is then placed into a container (e.g., another syringe) to permit subsequent administration of the medication to a patient. In some instances, the original syringe is used as the medication administration container.

A conventional syringe includes a barrel having an elongated body that defines a chamber that receives and holds a medication that is disposed at a later time. The barrel has an open proximal end with a flange being formed thereat and it also includes an opposing distal end that has a barrel tip that has a passageway formed therethrough. The passageway terminates in an outer surface of the barrel tip that conforms to the specification for a male luer fitting and can include features to permit closure of the passageway with a cap. As previously mentioned, the term "medication" refers to a medicinal preparation for administration to a patient and most often, the medication is contained within the chamber in a liquid state even though the medication initially may have been in a solid state, which was processed into a liquid state. The syringe further includes a plunger that is removably and adjustably disposed within the barrel.

Drugs intended for injection must be in a liquid state. Many drugs intended for injection are initially provided of the shelf in solid (powdered) form within an injectable drug vial that is initially stored in a drug cabinet or the like. To prepare an injectable unit dose of medication, a prescribed amount of diluent (water or some other liquid) is added to the vial to cause the solid drug to go completely into solution. Mixing and agitation of the vial contents is usually required. This can be a time consuming and labor intensive operation since first it must be determined how much diluent to add to achieve the desired concentration of medication and then this precise amount needs to be added and then the vial contents need to be mixed for a predetermined time period to ensure that all of the solid goes into solution. Thus, there is room for human error in that the incorrect amount of diluent may be added, thereby producing medication that has a concentration that is higher or lower than it should be. This can potentially place the patient at risk. The reconstitution process can be very labor intensive since it can entail preparing a considerable number of medication syringes that all can have different medication formulations. This also can lead to confusion and possibly human error. Finally, the human may begin withdrawing fluid from the vial before the drug is completely dissolved, especially if tired from repetitive preparations, causing the concentration to be lower than it should be or causing undissolved drug particles to be included in the syringe. This, too, presents a hazard to the patient.

If the medication needs to be reconstituted, the medication initially comes in a solid form and is contained in an injectable drug vial and then the proper amount of diluent is added and the vial is agitated to ensure that all of the solid goes into solution, thereby providing a medication having the desired concentration. The drug vial is typically stored in a drug cabinet or the like and is then delivered to other stations where it is processed to receive the diluent. As is known, the drug vial typically includes a pierceable septum that acts as a seal and prevents unwanted foreign matter from entering into the drug vial so as to contaminate the contents thereof as well as keeping the contents safely within the interior of the drug vial when the drug is stored or even during an application. The septum is typically formed of a rubber material that can be pierced by a sharp, hollow transfer device (e.g., a cannula or needle) to permit communication with the interior of the drug vial and then when the transfer device is removed the small piercing hole seals itself due to the material properties of the septum.

Typically, the medication is aspirated or otherwise withdrawn from the drug vial into a fluid conduit that can be in the form of a section of tubing or can be a cannula or a syringe. Unfortunately, one of the side effects that can occur when the medication is aspirated is that unwanted foreign particles or the like can be aspirated along with the medication into the fluid conduit. For example, the foreign particles can be in the form of particles of undissolved drug, dislodged particles of the septum, or any other foreign matter that may have found its way into the drug vial. Since the aspirated drug is intended for use in an application to a patient, the unwanted foreign matter can potentially pose a safety risk or at the very least is a sign of contamination of the drug delivery process and can raise other issues about the overall reliability. In addition, a unit dose of medication is carefully measured out for the patient and therefore, the presence of foreign matter reduced the overall volume of drug that is measured and delivered to the patient. In other words, the actual amount of drug that is dispensed is less than the apparent amount that is aspirated due to the presence of the foreign matter. Moreover and at the very least, the presence of foreign matter constitutes a contamination of the unit dose and often requires that the unit dose be discarded. This results in waste of the drug and increases the overall cost of the drug.

What is needed in the art and has heretofore not been available is a system and method for automating the medication preparation process and more specifically, a safety and cost reducing feature that is capable of detecting unwanted foreign matter that may be present in a unit dose of medication that is withdrawn from a drug vial.

SUMMARY

In one exemplary embodiment, an automated medication preparation system including automated syringe preparation that involves reconstitution of the medication is provided. The system includes: an automated device for delivering a prescribed unit dose of medication to the syringe by delivering the medication through the uncapped barrel. In one embodiment, this is done in a just-in-time for use manner. One exemplary automated device for delivering a prescribed unit dose of medication to the syringe is in the form of an automated device having a fluid delivery device that is movable in at least one direction. The fluid delivery device is adapted to perform the following operations: (1) receiving and discharging diluent from a diluent supply in a prescribed amount to reconstitute the medication in a drug vial; and (2) aspirating and later discharging reconstituted medication from the drug vial into the syringe.

The system further includes a sensor for detecting any foreign matter (e.g., undissolved drug, pieces of septum, etc.) present in the reconstituted unit dose of drug prior to transfer of the reconstituted drug (unit dose) to the syringe. If foreign matter is detected, then the reconstituted drug is prevented from being delivered to the syringe, otherwise, the reconstituted drug is delivered to the syringe. Alternatively, the syringe can be prepared but set aside for visual inspection. There are some cases in which the detection of particle in the fluid line might or might not result in the presence of a particle in the syringe itself.

The ability to sense particles may also sense the presence of air bubbles and may find them indistinguishable. Therefore, the sensor(s) that detect the presence of particles in the fluid pathway must be able to differentiate between solid particles and air bubbles.

In one embodiment, the first sensor is a photoelectric sensor that detects any reflection of an emitted beam which is indicative of foreign matter being present in the medication that is contained within a fluid conduit that forms a part of the fluid delivery device. More specifically, an exemplary first sensor includes a light-emitting element for producing the light beam and a light-receiving element for receiving any light beam that reflects off of the foreign matter and then generates and sends a signal to a master controller if the first sensor detects the foreign matter. The system is preferably configured to be able to differentiate between a presence of air bubbles in the medication and the presence of unwanted foreign matter, wherein if air bubbles are present in the medication, the master controller still instructs the dosage amount of medication to be delivered to the syringe.

In order to accomplish this, a second sensor is provided to complement the first sensor. The second sensor is photoelectric sensor that lacks sensitivity to detect small minute particles, such as undissolved drug, but is capable of detecting small air bubbles and generates a signal when air bubbles are detected. More specifically, the second sensor can be in the form of a definite-reflective sensor that is placed adjacent the first sensor exterior to the main conduit. The first sensor is preferably a diffusive-reflective sensor that is capable of detecting both air bubbles and solid particles due to its high sensitivities and the second sensor in combination with the first sensor forms a filter to filer out false positives that can result if the first sensor detects air bubbles as opposed to solid particles such that if the master controller receives signals from both the first and second sensors then the master controller filters out the false positive and the aspirated unit dose of medication is delivered to the syringe.

Further aspects and features of the exemplary automated safety cap removal mechanism disclosed herein can be appreciated from the appended Figures and accompanying written description.

BRIEF DESCRIPTION OF THE DRAWINGS

FIG. 13 is a cross-sectional view taken along the line 13—13 of FIG. 12;

FIG. 14 is a side elevation view of the fluid transfer device in a sixth position in which the fluid delivery system is rotated to the rotary dial that contains the nested syringes;

FIG. 15 is a side elevation view of the fluid transfer device in a seventh position in which the fluid delivery system is retracted so that a cannula or the like thereof is inserted into the syringe to permit the aspirated unit dose of medication to be delivered to the syringe; and FIG. 16 is a side elevation view of a fluid pump system that is located in the fluid transfer area shown in a one operating position.

DETAILED DESCRIPTION OF PREFERRED EMBODIMENTS

Figure 1:
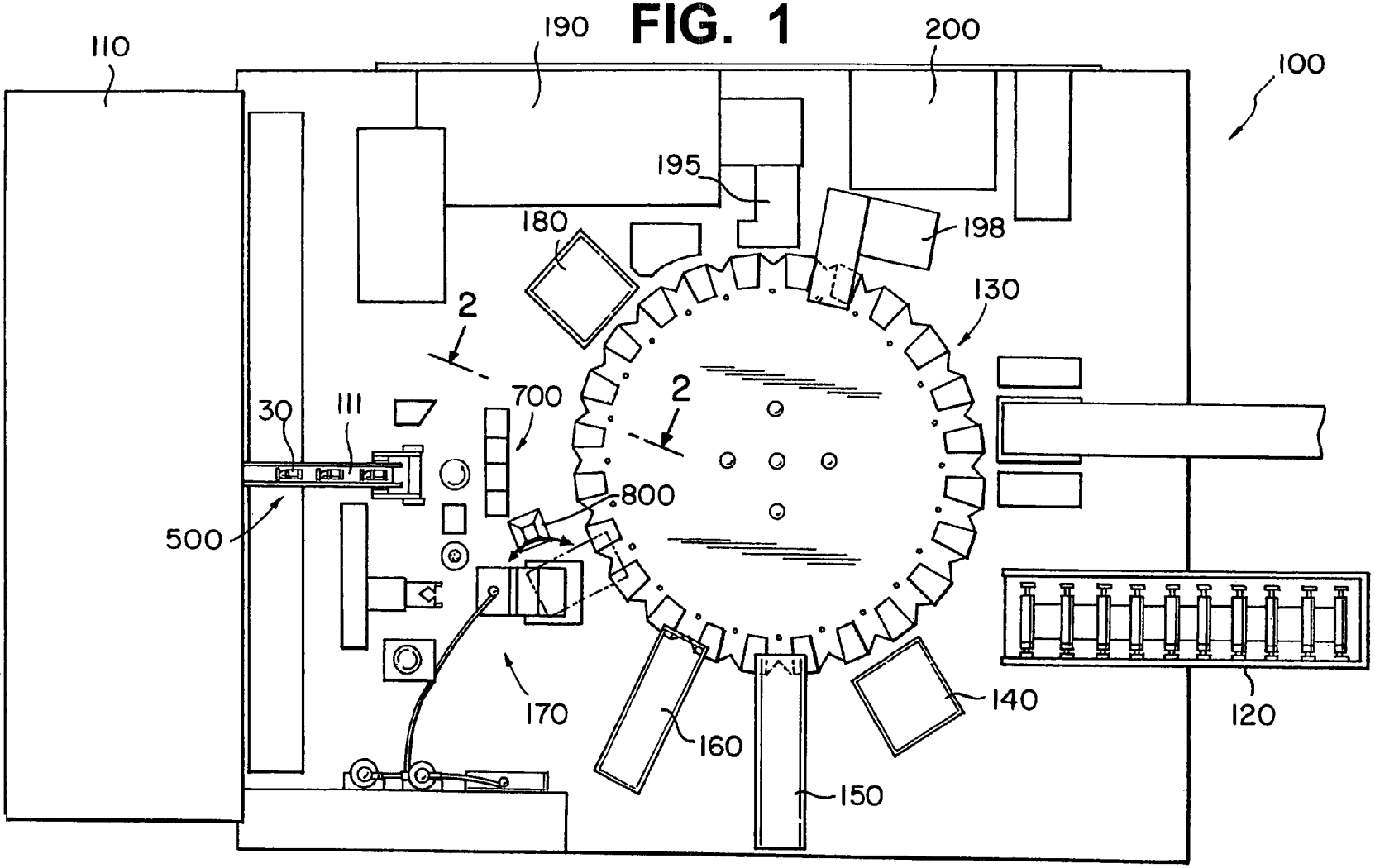
FIG. 1 is a perspective view of a conventional syringe having a safety tip cap removed therefrom.

FIG. 1 is a schematic diagram illustrating one exemplary automated system, generally indicated at 100, for the preparation of a medication. The automated system 100 is divided into a number of stations where a specific task is performed based on the automated system 100 receiving user input instructions, processing these instructions and then preparing unit doses of one or more medications in accordance with the instructions. The automated system 100 includes a station 110 where medications and other substances used in the preparation process are stored. As used herein, the term "medication" refers to a medicinal preparation for administration to a patient. Often, the medication is initially stored as a solid, e.g., a powder, to which a diluent is added to form a medicinal composition. Thus, the station 110 functions as a storage unit for storing one or medications, etc. under proper storage conditions. Typically, medications and the like are stored in sealed containers, such as vials, that are labeled to clearly indicate the contents of each vial.

A first station 120 is a syringe storage station that houses and stores a number of syringes. For example, up to 500 syringes or more can be disposed in the first station 120 for storage and later use. The first station 120 can be in the form of a bin or the like or any other type of structure than can hold a number of syringes. In one exemplary embodiment, the syringes are provided as a bandolier structure that permits the syringes to be fed into the other components of the system 100 using standard delivery techniques, such as a conveyor belt, etc.

The system 100 also includes a rotary apparatus 130 for advancing the fed syringes from and to various stations of the system 100. A number of the stations are arranged circumferentially around the rotary apparatus 130 so that the syringe is first loaded at the first station 120 and then rotated a predetermined distance to a next station, etc. as the medication preparation process advances. At each station, a different operation is performed with the end result being that a unit dose of medication is disposed within the syringe that is then ready to be administered.

One exemplary type of rotary apparatus 130 is a multiple station cam-indexing dial that is adapted to perform material handling operations. The indexer is configured to have multiple stations positioned thereabout with individual nests for each station position. One syringe is held within one nest using any number of suitable techniques, including opposing spring-loaded fingers that act to clamp the syringe in its respective nest. The indexer permits the rotary apparatus 130 to be advanced at specific intervals.

At a second station 140, the syringes are loaded into one of the nests of the rotary apparatus 130. One syringe is loaded into one nest of the rotary apparatus 130 in which the syringe is securely held in place. The system 100 preferably includes additional mechanisms for preparing the syringe for use, such as removing a tip cap and extending a plunger of the syringe at a third station 150. At this point, the syringe is ready for use.

The system 100 also preferably includes a reading device (not shown) that is capable of reading a label disposed on the sealed container containing the medication. The label is read using any number of suitable reader/scanner devices, such as a bar code reader, etc., so as to confirm that the proper medication has been selected from the storage unit of the station 110. Multiple readers can be employed in the system at various locations to confirm the accuracy of the entire process. Once the system 100 confirms that the sealed container that has been selected contains the proper medication, the container is delivered to a fourth station 160 using an automated mechanism, such a robotic gripping device as will be described in greater detail. At the fourth station 160, the vial is prepared by removing the safety cap from the sealed container and then cleaning the exposed end of the vial. Preferably, the safety cap is removed on a deck of the automated system 100 having a controlled environment. In this manner, the safety cap is removed just-in-time for use.

The system 100 also preferably includes a fifth station (fluid transfer station) 170 for injecting or delivering a diluent into the medication contained in the sealed container and then subsequently mixing the medication and the diluent to form the medication composition that is to be disposed into the prepared syringe. At this fluid transfer station, the prepared medication composition is withdrawn from the container (i.e., vial) and is then delivered into the syringe. For example, a cannula can be inserted into the sealed vial and the medication composition then aspirated into a cannula set. The cannula is then withdrawn from the vial and is then rotated relative to the rotary apparatus 130 so that it is in line with (above, below, etc.) the syringe. The unit dose of the medication composition is then delivered to the syringe, as well as additional diluent if necessary or desired. The tip cap is then placed back on the syringe at a sixth station 180. A seventh station 190 prints and station 195 applies a label to the syringe and a device, such as a reader, can be used to verify that this label is placed in a correct location and the printing thereon is readable. Also, the reader can confirm that the label properly identifies the medication composition that is contained in the syringe. The syringe is then unloaded from the rotary apparatus 130 at an unloading station 200 and delivered to a predetermined location, such as a new order bin, a conveyor, a sorting device, or a reject bin. The delivery of the syringe can be accomplished using a standard conveyor or other type of apparatus. If the syringe is provided as a part of the previously-mentioned syringe bandolier, the bandolier is cut prior at a station 198 located prior to the unloading station 200. The various devices that form a part of the system 100 as well as a detailed explanation of the operations that are performed at each station are described in greater detail in U.S. patent application Ser. No. 10/728,371; 10/426,910; 10/728,364; and 10/728,363 as well as International patent application Serial No. PCT/US03/38581, all of which are hereby incorporated by reference in their entirety.

Figure 4:
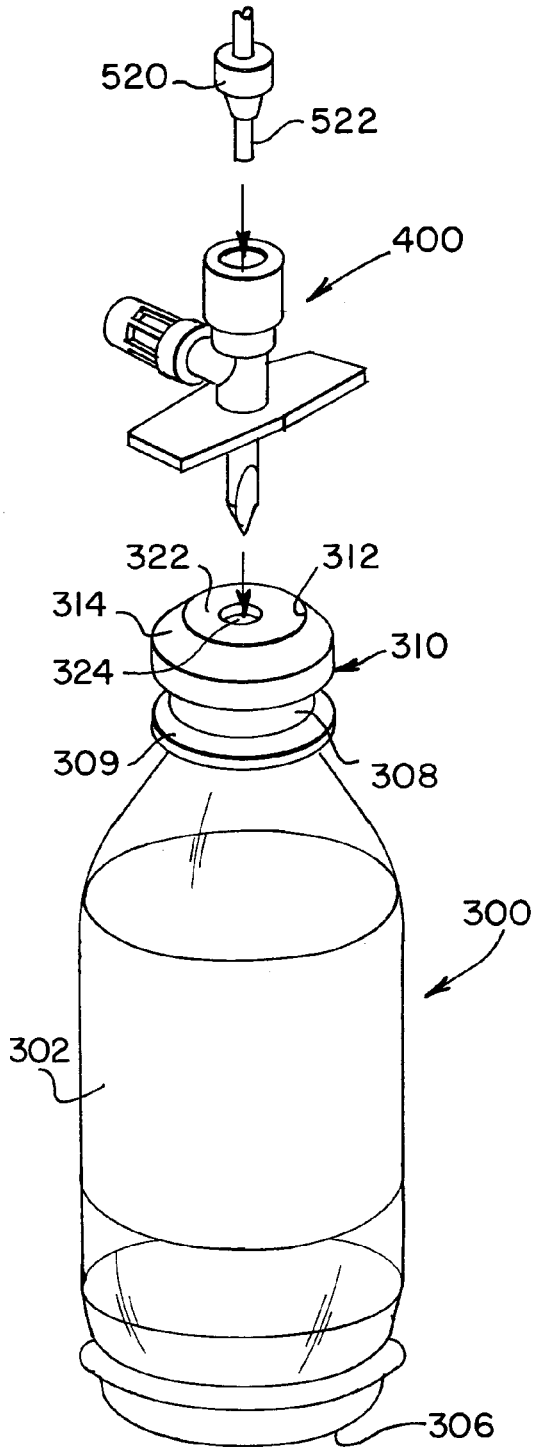
FIG. 4 is a perspective view of a drug vial and a fluid transfer device (dispensing pin) according to a first embodiment.
Figure 5:
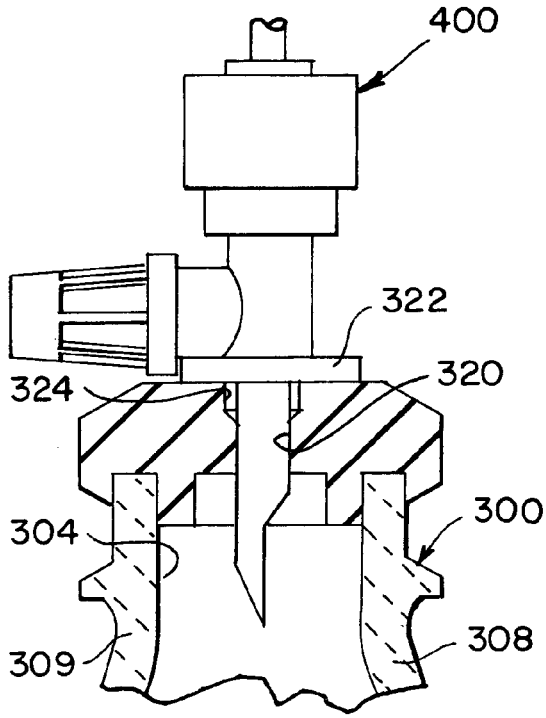
FIG. 5 is a cross-sectional view of the fluid transfer device of FIG. 4 being sealingly mated with a septum of the drug vial.
Figure 6:
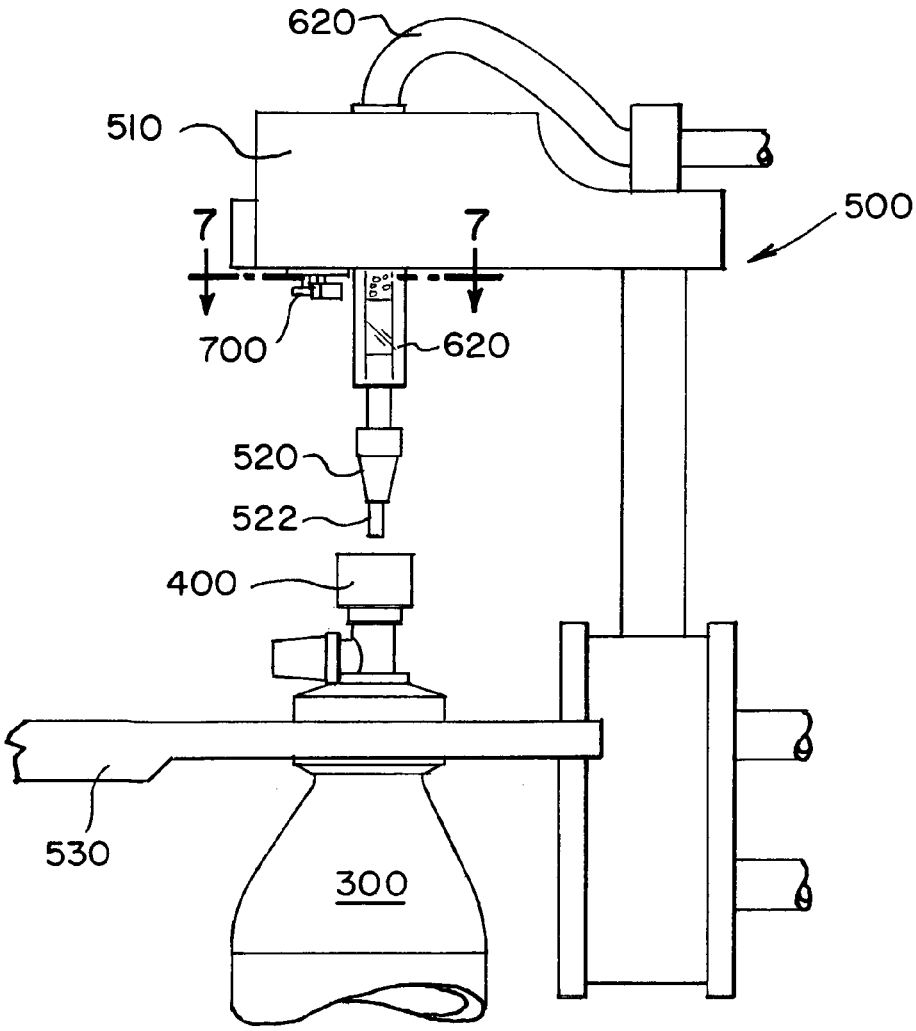
FIG. 6 is a side elevation view of the fluid delivery system retracted from the vial as well as a vision detection system for detecting the presence of unwanted foreign matter in an aspirated unit dose of medication.

FIG. 4 shows one type of drug vial 300 that in its simple terms is a drug container that has a vial body 302 for storing a drug and a cap member or some other type of closure element 310 that is sealingly mated to an open end 304 of the drug container 300 opposite a closed end 306. The cap member 310 can be releasably attached to the open end 304 or it can be permanently attached after the contents are disposed within the vial body 302. The vial body 302 is preferably made of a transparent material so that the contents therein are visible, with one preferred material being glass. The illustrated drug vial 300 has a neck portion 308 near the open end 304 that tapers inwardly from a lower section of the vial body 302 such that the open end 304 has a diameter that is less than a diameter of the closed end 306. The neck portion 308 can also include an annular flange 309 that extends therearound and can be used to assist an individual or a robot that is part of an automated system in grasping and holding the drug vial 300 and moving it from one location to another one. In addition, the open end 304 itself can include an annular flange member 303 that is formed thereat to assist in attaching the cap member 310 to the vial body 302 as explained below.

The illustrated cap member 310 is of the type that includes a central opening 312 formed therethrough. As shown, the central opening 312 is preferably a circular opening that it formed over the opening of the end 304 of the vial body 302. This permits the contents in the vial body 302 to selectively travel through open end 304 and through the central opening 312. The exemplary cap member 310 is made of a metal material and can be crimped onto or otherwise attached to the annular flange member 303 at the open end 302 such that a peripheral planar top surface 314 that is formed around and defines the central opening 312 is disposed over the opening at end 304.

The drug vial 300 also includes a pierceable septum 320 that is at least partially disposed within the vial body 302 and more particularly within the open end 304. The pierceable septum 320 can be in the form of a rubber stopper that is generally hollow and includes a top surface 322 of reduced thickness to permit a cannula or the like to easily pierce the top surface of the septum 320. Once the top surface 322 is pierced, the member that pierces the surface can communicate directly with the interior of the vial body 302 and more particularly can be placed into contact with the contents in the vial body 302 for the purpose of withdrawing the contents or in the case where the cannula is used to inject a fluid into the vial body 302, the piercing member merely needs to pierce the septum 320 and be placed within the vial body 302. To create an even more easily pierceable top surface, the top surface 322 can include a recessed portion 324 (e.g., a dimple) that that is of reduced thickness relative to the surrounding portions of the septum 320. Optionally, a fluid transfer device 400 can be securely received in and attached to the drug vial 300 to facilitate fluid mating between the fluid delivery device and the drug vial 300. One type of fluid transfer device 400 is a dispensing pin and is described in great detail in Applicants' U.S. patent application Ser. No. 10/821,268; entitled DEVICE FOR RECONSTITUTING A DRUG VIAL AND TRANSFERRING THE CONTENTS TO A SYRINGE IN AN AUTOMATED MATTER, which is hereby incorporated by reference in its entirety. It will be understood that the fluid transfer device 400 does not have to be used but rather a conventional cannula can simply repeatedly pierce the septum 320.

Figure 2:
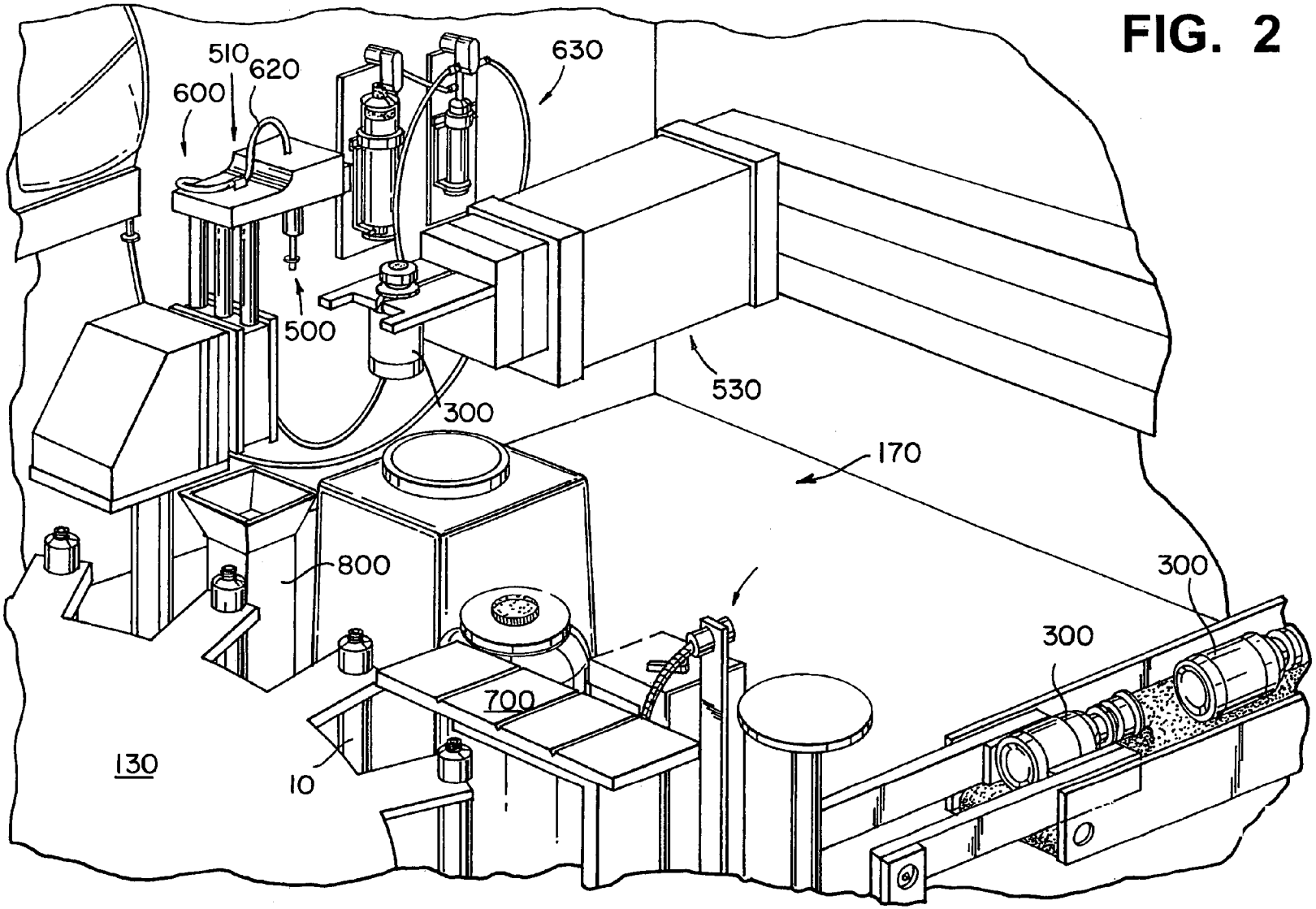
FIG. 2 is a diagrammatic plan view of an automated system for preparing a medication to be administered to a patient.
Figure 3:
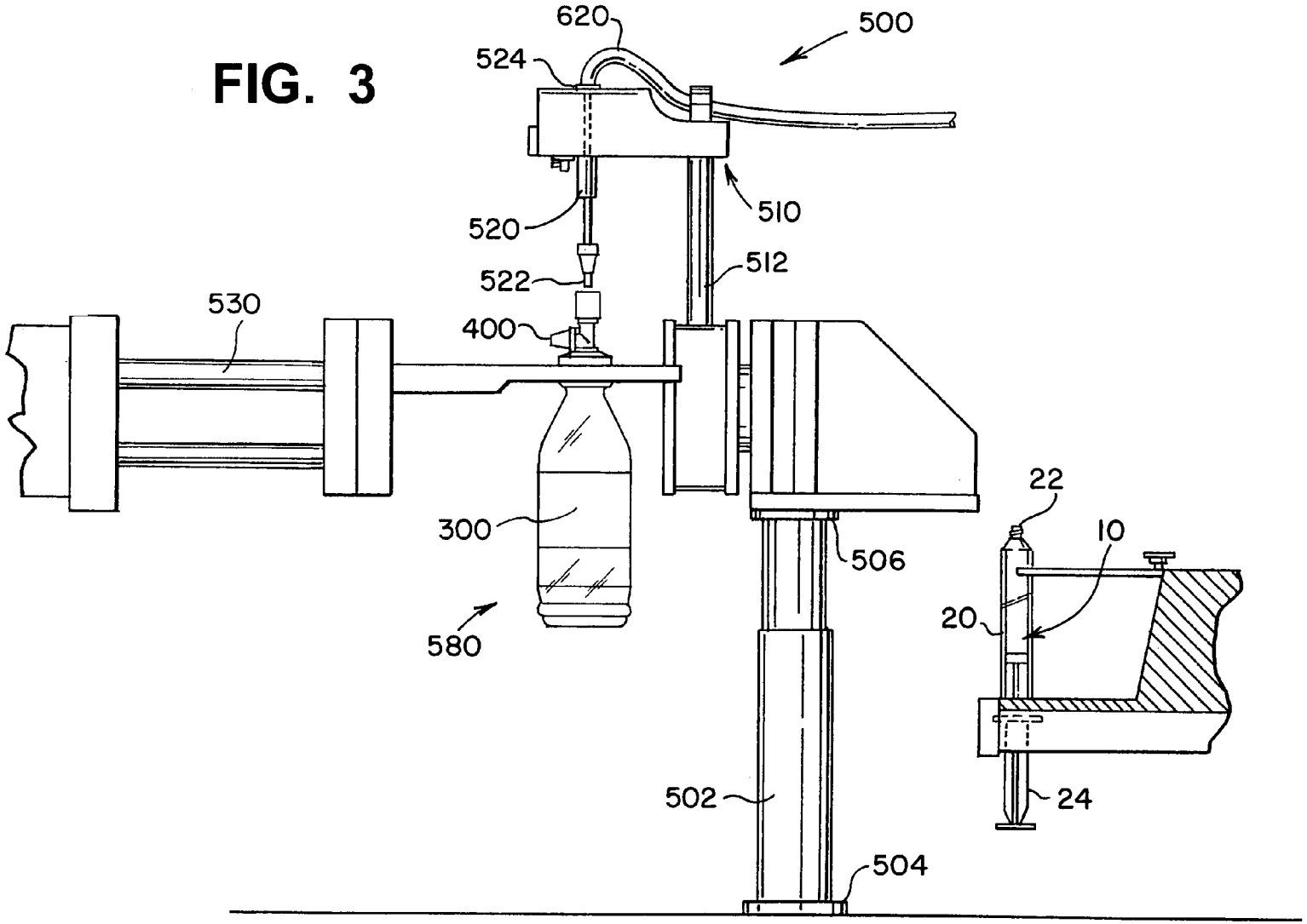
FIG. 3 is a side elevation view of a fluid transfer device in a first position where a fluid delivery system is in a retracted position and a vial gripper device moves the vial into a fluid transfer position.

FIGS. 2 through 16 illustrate parts of the fluid transfer station 170 for preparing the syringe for later use in which the transfer device 400 is used in the delivery and/or withdrawal of fluid from the vial 300. As shown in FIGS. 2–3, one exemplary cannula unit 500 can include a vertical housing 502 that is rotatably coupled to a base 504 between the ends thereof. At an upper end 506 of the housing 502, a cannula housing 510 is operatively coupled thereto such that the cannula housing 510 can be independently moved in a controlled up and down manner so to either lower it or raise it relative to the drug vial 300, and more particularly, relative to the transfer device 400, in the fluid transfer position. For example, the cannula housing 510 can be pneumatically operated and therefore, can include a plurality of shafts 512 which support the cannula housing 510 and extend into an interior of the vertical housing 502 such that when the device is pneumatically operated, the shafts 512 can be driven either out of or into the housing 502 resulting in the cannula housing 510 either being raised or lowered, respectively.

At one end of the cannula housing 510 opposite the end that is coupled to the vertical housing 502, the cannula housing 510 includes a cannula 520. The cannula 520 has a distal end 522 that serves to interact with the transfer device 400 for delivering or withdrawing fluid from the drug vial 300 and an opposite end 524 that is operatively coupled to a fluid source, such as a diluent, via tubing or the like. Instead of a cannula or the like, the housing 510 can contain and hold in place a section of fluid conduit (tubing) with a luer fitting or some other type of fitting at the end.

A robotic device 530 then advances forward to a fluid transfer station 530. The fluid transfer station 530 is an automated station where the medication (drug) can be processed so that it is in a proper form for injection into one of the syringes 10 that is coupled to the rotary dial 130. When the vial 300 contains only a solid medication and it is necessary for a diluent (e.g., water or other fluid) to be added to liquify the solid, this process is called a reconstitution process. Alternatively and as will be described in detail below, the medication can already be prepared and therefore, in this embodiment, the fluid transfer station is a station where a precise amount of medication is simply aspirated or withdrawn from the vial 300 and delivered to the syringe 10.

The precise steps of a reconstitution process and of an aspiration process using the cannula unit 500 are described in great detail in the previously incorporated U.S. patent applications which are assigned to the present assignee.

The cannula unit 500 includes a fluid delivery system 600 which includes a main conduit 620 that is operative coupled to the cannula 520 for delivering fluid thereto in a controlled manner, with an opposite end of the main conduit 620 being connected to a fluid pump system 630 that provides the means for creating a negative pressure in the main conduit 620 to cause a precise amount of fluid to be withdrawn into the cannula 520 and the main conduit 620 as well as creating a positive pressure in the main conduit 620 to discharge the fluid (either diluent or medication) that is stored in the main conduit 620 proximate the cannula 520. In the illustrated embodiment, particularly shown in FIG. 16, the fluid pump system 630 includes a first syringe 632 and a second syringe 634, each of which has a plunger or the like 638 which serves to draw fluid into the syringe or expel fluid therefrom. The main difference between the first and second syringes 632, 634 is that the amount of fluid that each can hold. In other words, the first syringe 632 has a larger diameter barrel and therefore has increased holding capacity relative to the second syringe 634. As will be described in detail below, the first syringe 632 is intended to receive and discharge larger volumes of fluid, while the second syringe 634 performs more of a fine tuning operation in that it precisely can receive and discharge small volumes of fluid.

The syringes 632, 634 are typically mounted so that an open end 636 thereof is the uppermost portion of the syringe and the plunger 638 is disposed so that it is the lowermost portion of the syringe. Each of the syringes 632, 634 is operatively connected to a syringe driver, generally indicated at 640, which serves to precisely control the movement of the plunger 638 and thus precisely controls the amount (volume) of fluid that is either received or discharged therefrom. More specifically, the driver 640 is mechanically linked to the plunger 638 so that controlled actuation thereof causes precise movements of the plunger 638 relative to the barrel of the syringe. In one embodiment, the driver 640 is a stepper motor that can precisely control the distance that the plunger 638 is extended or retracted, which in turn corresponds to a precise volume of fluid being aspirated or discharged. Thus, each syringe 632, 634 has its own driver 640 so that the corresponding plunger 638 thereof can be precisely controlled and this permits the larger syringe 632 to handle large volumes of fluid, while the smaller syringe 634 handles smaller volumes of fluid. As is known, stepper motors can be controlled with a great degree of precision so that the stepper motor can only be driven a small number of steps which corresponds to the plunger 638 being moved a very small distance. On the other hand, the stepper motor can be driven a large number of steps which results in the plunger 638 being moved a much greater distance. The drivers 640 are preferably a part of a larger automated system that is in communication with a master controller that serves to monitor and control the operation of the various components. For example, the master controller calculates the amount of fluid that is to be either discharged from or aspirated into the cannula 520 and the main conduit 620 and then determines the volume ratio as to how much fluid is to be associated with the first syringe 632 and how much fluid is to be associated with the second syringe 634. Based on these calculations and determinations, the controller instructs the drivers 640 to operate in a prescribed manner to ensure that the precise amount of volume of fluid is either discharged or aspirated into the main conduit 620 through the cannula 520.

The open end 636 of each syringe 632, 634 includes one or more connectors to fluidly couple the syringe 632, 634 with a source 650 of diluent and with the main conduit 620. In the illustrated embodiment, the first syringe 632 includes a first T connector 660 that is coupled to the open end 636 and the second syringe 634 includes a second T connector 662 that is coupled to the open end 636 thereof. Each of the legs of the T connectors 660, 662 has an internal valve mechanism or the like 670 that is associated therewith so that each leg as well as the main body that leads to the syringe itself can either be open or closed and this action and setting is independent from the action at the other two conduit members of the connector. In other words and according to one preferred arrangement, the valve 670 is an internal valve assembly contained within the T connector body itself such that there is a separate valve element for each leg as well as a separate valve element for the main body. It will be appreciated that each of the legs and the main body defines a conduit section and therefore, it is desirable to be able to selectively permit or prevent flow of fluid in a particular conduit section.

In the illustrated embodiment, a first leg 661 of the first T connector 660 is connected to a first conduit 656 that is connected at its other end to the diluent source 650 and the second leg 663 of the first T connector 660 is connected to a connector conduit (tubing) 652 that is connected at its other end to the first leg of the second T connector 662 associated with the second syringe 634. A main body 665 of the first T connector 660 is mated with the open end 636 of the first syringe 632 and defines a flow path thereto. The connector conduit 652 thus serves to fluidly connect the first and second syringes 632, 634. As previously mentioned, the valve mechanism 670 is preferably of the type that includes three independently operable valve elements with one associated with one leg 661, one associated with the other leg 663 and one associated with the main body 665.

With respect to the second T connector 662, a first leg 667 is connected to the connector conduit 652 and a second leg 669 is connected to a second conduit 658 that is connected to the main conduit 620 or can actually be simply one end of the main conduit. A main body 671 of the second T connector 662 is mated with the open end 636 of the second syringe 634. As with the first T connector 660, the second T connector 662 includes an internal valve mechanism 670 that is preferably of the type that includes three independently operable valve elements with one associated with one leg 667, one associated with the other leg 669 and one associated with the main body 671.

The operation of the fluid pump system 630 is now described with reference to FIGS. 2 and 16. If the operation to be performed is a reconstitution operation, the valve 670 associated with the second leg 669 is first closed so that the communication between the syringes and the main conduit 620 is restricted. The valve element 670 associated with first leg 661 of the T connector 660 is left open so that a prescribed amount of diluent can be received from the source 650. The valve element associated with the second leg 663 of the T connector 660 is initially closed so that the diluent from the diluent source 650 is initially drawn into the first syringe 630 and the valve element associated with the main body 665 is left open so that the diluent can flow into the first syringe 632. The driver 640 associated with the first syringe 632 is then actuated for a prescribed period of time resulting in the plunger 638 thereof being extended a prescribed distance. As previously mentioned, the distance that the driver 640 moves the corresponding plunger 638 is directly tied to the amount of fluid that is to be received within the syringe 632. The extension of the plunger 638 creates negative pressure in the first syringe 632, thereby causing diluent to be drawn therein.

Once the prescribed amount of fluid is received in the first syringe 632, the valve element associated with the main body 665 of the T connector 660 is closed and the valve element associated with the second leg 663 is open, thereby permitting flow from the first T connector 660 to the second T connector 662. At the same time, the valve element associated with the first leg 667 and the main body 671 of the second T connector 662 are opened (with the valve element associated with the second leg 669 being kept closed).

The driver 640 associated with the second syringe 634 is then actuated for a prescribed period of time resulting in the plunger 638 thereof being extended a prescribed distance which results in a precise, prescribed amount of fluid being drawn into the second syringe 634. The extension of the plunger 638 creates negative pressure within the barrel of the second syringe 634 and since the second T connector 662 is in fluid communication with the diluent source 650 through the first T connector 660 and the connector conduit 652, diluent can be drawn directly into the second syringe 632. The diluent is not drawn into the first syringe 660 since the valve element associated with the main body 665 of the first T connector 660 is closed.

Thus, at this time, the first and second syringes 632, 634 hold in total at least a prescribed volume of diluent that corresponds to at least the precise volume that is to be discharged through the cannula 520 into the vial 300 to reconstitute the medication contained therein.

It will be understood that all of the conduits, including those leading from the source 650 and to the cannula are fully primed with diluent prior to performing any of the above operations.

To discharge the prescribed volume of diluent into the vial, the process is essentially reversed with the valve 670 associated with the first leg 661 of the T connector 660 is closed to prevent flow through the first conduit 656 from the diluent source 650. The valve element associated with the second leg 669 of the second T connector 662 is opened to permit fluid flow therethrough and into the second conduit 658 to the cannula 520. The diluent that is stored in the first and second syringes 632, 634 can be delivered to the second conduit 658 in a prescribed volume according to any number of different methods, including discharging the diluent from one of the syringes 632, 634 or discharging the diluent from both of the syringes 634. For purpose of illustration only, it is described that the diluent is drawn from both of the syringes 632, 634.

The diluent contained in the first syringe 632 can be introduced into the main conduit 620 by opening the valve associated with the second leg 663 and the main body 665 of the first T connector 660 as well as opening up the valve element associated with the first leg 667 of the second T connector 662, while the valve element associated with the main body 671 of the second T connector 662 remains closed. The valve element associated with the second leg 669 remains open. The driver 640 associated with the first syringe 632 is operated to retract the plunger 638 causing a positive pressure to be exerted and resulting in a volume of the stored diluent being discharged from the first syringe 632 into the connector conduit 652 and ultimately to the second conduit 658 which is in direct fluid communication with the cannula 520. The entire volume of diluent that is needed for the reconstitution can be taken from the first syringe 632 or else a portion of the diluent is taken therefrom with an additional amount (fine tuning) to be taken from the second syringe 634.

When it is desired to withdraw diluent from the second syringe 634, the valve associated with the first leg 667 of the second T connector 662 is closed (thereby preventing fluid communication between the syringes 632, 634) and the valve associated with the main body 671 of the second T connector 662 is opened. The driver 640 associated with the second syringe 634 is then instructed to retract the plunger 638 causing a positive pressure to be exerted and resulting in the stored diluent being discharged from the second syringe 634 into the second conduit 658. Since the second conduit 658 and the main conduit 620 are fully primed, any new volume of diluent that is added to the second conduit 658 by one or both of the first and second syringes 632, 634 is discharged at the other end of the main conduit 620. The net result is that the prescribed amount of diluent that is needed to properly reconstitute the medication is delivered through the cannula 520 and into the vial 300. These processing steps are generally shown in FIGS. 8–15 in which the cannula 520 pierces the septum of the vial and then delivers the diluent to the vial and then the cannula unit 590 and the vial gripper device 530 are inverted to cause agitation and mixing of the contents of the vial.

It will be understood that in some applications, only one of the first and second syringes 632, 634 may be needed to operate to first receive diluent from the diluent source 650 and then discharge the diluent into the main conduit 520.

Figure 10:
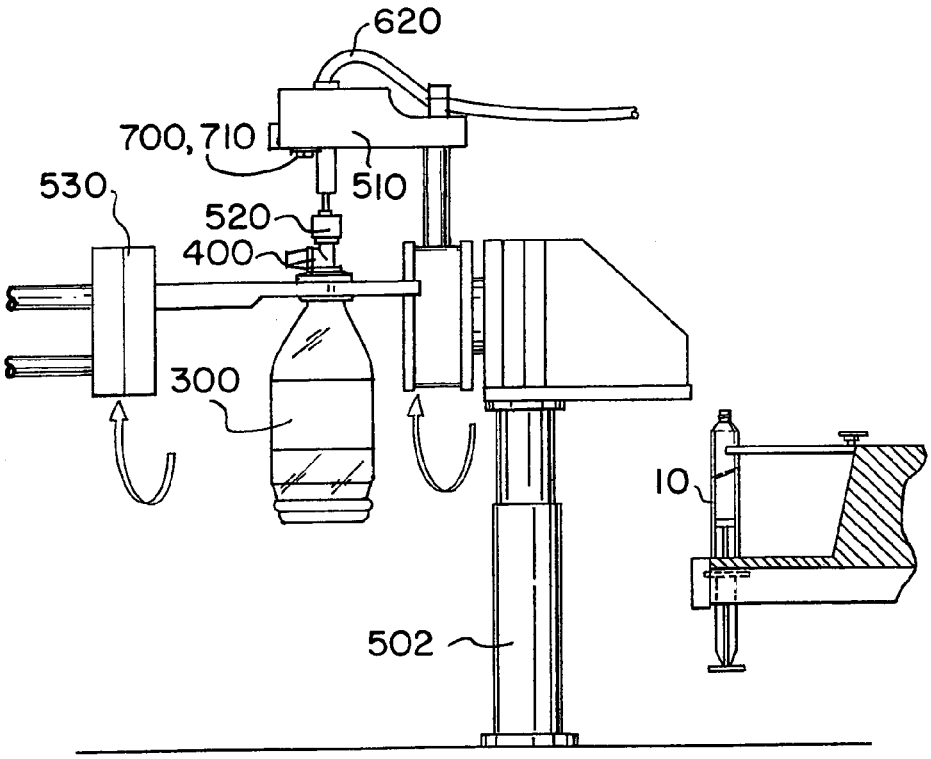
FIG. 10 is a side elevation view of the fluid delivery system in a fourth position in which the fluid delivery system and the vial gripper device are rotated back to the original positions.
Figure 12:
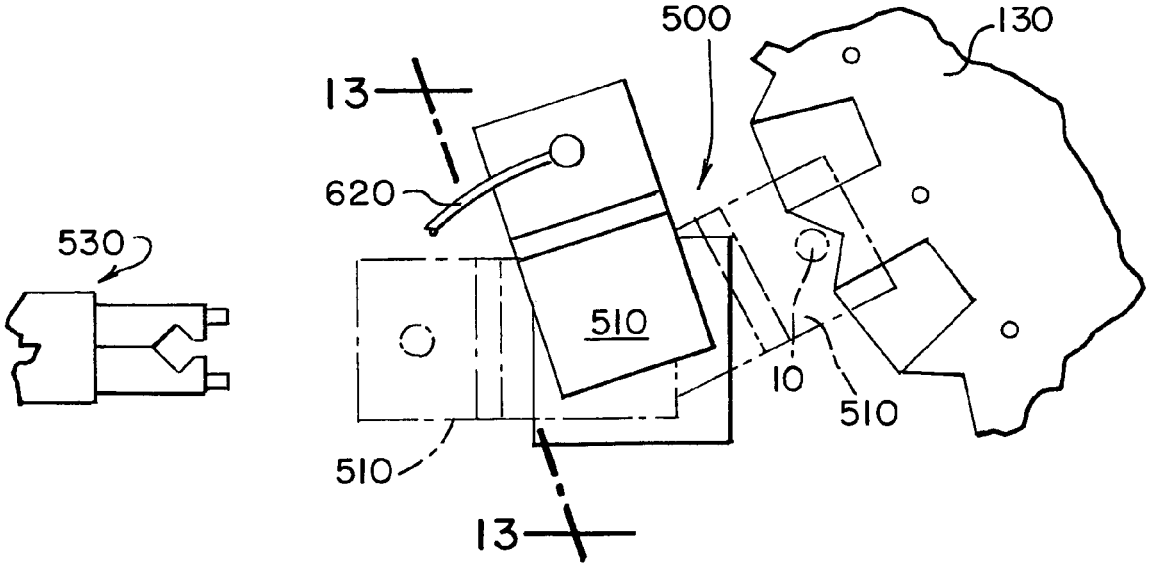
FIG. 12 is a top plan view of the fluid delivery device showing the various positions of the fluid delivery device relative to a syringe rotary dial.
Figure 11:
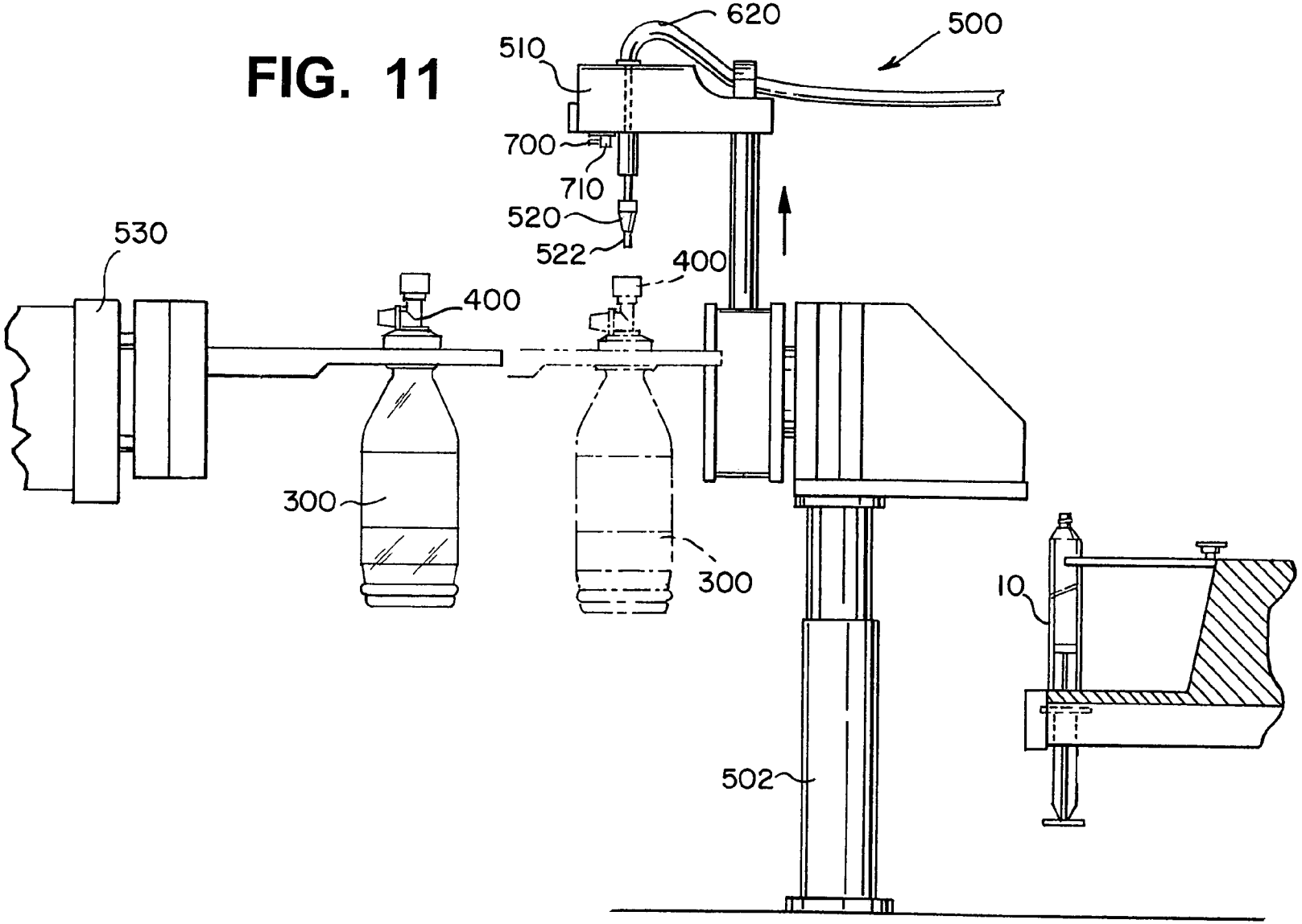
FIG. 11 is a side elevation view of the fluid delivery system in a fifth position in which the fluid delivery system is retracted and contains the aspirated unit dose of medication for delivery to a syringe.

After the medication in the vial 300 has been reconstituted as by inversion of the vial and mixing, as described herein, the fluid pump system 630 is then operated so that a prescribed amount of medication is aspirated or otherwise drawn from the vial 300 through the cannula 520 and into the main conduit 620 as shown in FIGS. 10–11. Before the fluid is aspirated into the main conduit 620, an air bubble is introduced into the main conduit 620 to serve as a buffer between the diluent contained in the conduit 620 to be discharged into one vial and the aspirated medication that is to be delivered and discharged into one syringe 10. It will be appreciated that the two fluids (diluent and prepared medication) can not be allowed to mix together in the conduit 620. The air bubble serves as an air cap in the tubing of the cannula and serves as an air block used between the fluid in the line (diluent) and the pulled medication. According to one exemplary embodiment, the air block is a 1/10 ml air block; however, this volume is merely exemplary and the size of the air block can be varied.

The aspiration operation is essentially the opposite of the above operation where the diluent is discharged into the vial 300. More specifically, the valve 670 associated with the first leg 661 of the first T connector 660 is closed and the valve associated with the second leg 669 of the second T connector 662 is opened to permit flow of the diluent in the main conduit into one or both of the syringes 632, 634. As previously mentioned, the second syringe 634 acts more as a means to fine tune the volume of the fluid that is either to be discharged or aspirated.

The drivers 640 associated with one or both of the first and second syringes 632, 634 are actuated for a prescribed period of time resulting in the plungers 638 thereof being extended a prescribed distance (which can be different from one another). As previously mentioned, the distance that the drivers 640 move the corresponding plungers 638 is directly tied to the volume of fluid that is to be received within the corresponding syringe 632, 634. By extending one or both of the plungers 638 by means of the drivers 640, a negative pressure is created in the main conduit 620 as fluid is drawn into one or both of the syringes 632, 634. The creation of negative pressure within the main conduit 620 and the presence of the tip end of the cannula 520 within the medication translates into the medication being drawn into the cannula 520 and ultimately into the main conduit 620 with the air block being present therein to separate the pulled medication and the fluid in the line.

It will be appreciated that the aspiration process can be conducted so that fluid is aspirated into one of the syringes 632, 634 first and then later an additional amount of fluid can be aspirated into the other syringe 632, 634 by simply controlling whether the valves in the main bodies 665, 671 are open or closed. For example, if fluid is to be aspirated solely to the first syringe 632, then the valve elements associated with the first and second legs 667, 669 of the second T connector 662 and the valve element associated with the second leg 663 and main body 665 of the first T connector 660 are all open, while the valve elements associated with the first leg 661 of the T connector 660 and the main body 671 of the T connector 662 remain closed. After a sufficient volume of fluid has been aspirated into the first syringe 632 and it is desired to aspirate more fluid into the second syringe 634, then the valve element associated with the first leg 667 simply needs to be closed and then the driver 640 of the second syringe 634 is actuated to extend the plunger 638.

After aspirating the medication into the main conduit 620, the fluid transfer device 580 is rotated as is described below to position the cannula 520 relative to one syringe 10 that is nested within the rotary dial 130 as shown in FIG. 15. Since the plungers 638 are pulled a prescribed distance that directly translates into a predetermined amount of medication being drawn into the main conduit 620, the plungers 638 are simply retracted (moved in the opposite direction) the same distance which results in a positive pressure being exerted on the fluid within the main conduit 620 and this causes the pulled medication to be discharged through the cannula 520 and into the syringe 10. During the aspiration operation and the subsequent discharge of the fluid, the valves are maintained at set positions so that the fluid can be discharged from the first and second syringes 632, 634. As the plungers 638 are retracted and the pulled medication is discharged, the air block continuously moves within the main conduit 620 toward the cannula 520. When all of the pulled (aspirated) medication is discharged, the air block is positioned at the end of the main conduit signifying that the complete pulled medication dose has been discharged; however, none of the diluent that is stored within the main conduit 620 is discharged into the syringe 10 since the fluid transfer device 580, and more particularly, the drivers 640 thereof, operates with such precision that only the prescribed medication that has been previously pulled into the main conduit 620 is discharged into the vial 300. The valve elements can be arranged so that the plungers can be retracted one at a time with only one valve element associated with the main bodies 665, 671 being open or the plungers can be operated at the same time.

It will be appreciated that the fluid transfer device 580 may need to make several aspirations and discharges of the medication into the vial 300 in order to inject the complete prescribed medication dosage into the vial 300. In other words, the cannula unit 590 can operate to first aspirate a prescribed amount of fluid into the main conduit 620 and then is operated so that it rotates over to and above one syringe 10 on the rotary dial 130, where one incremental dose amount is discharged into the vial 300. After the first incremental dose amount is completely discharged into the syringe 10, the vertical base section 582 is rotated so that the cannula unit 590 is brought back the fluid transfer position where the fluid transfer device 582 is operated so that a second incremental dose amount is aspirated into the main conduit 620 in the manner described in detail hereinbefore. The vertical base section 582 is then rotated again so that the cannula unit 590 is brought back to the rotary dial 130 above the syringe 10 that contains the first incremental dose amount of medication. The cannula 520 is then lowered so that the cannula tip is placed within the interior of the syringe 10 and the cannula unit 590 (drivers 640) is operated so that the second incremental dose amount is discharged into the syringe 10. The process is repeated until the complete medication dose is transferred into the syringe 10.

Once the syringe 10 receives the complete prescribed medication dose, the vial 300 that is positioned at the fluid transfer position can either be (1) discarded or (2) it can be delivered to a holding station where it is cataloged and held for additional future use. More specifically, the holding station serves as a parking location where a vial that is not completely used can be used later in the preparation of a downstream syringe 10. In other words, the vials 60 that are stored at the holding station are labeled as multi-use medications that can be reused. These multi-use vials 60 are fully reconstituted so that at the time of the next use, the medication is only aspirated from the vials 60 as opposed to having to first inject diluent to reconstitute the medication.

According to the present invention, a safety feature is provided for monitoring and observing the quality of the medication that is aspirated or otherwise removed from the drug vial 300 into the cannula 520 and the main conduit 620. More specifically, as the medication is withdrawn from the drug vial 300, foreign matter may be present and can be withdrawn along with the medication. For example, undissolved drug particles or other solid material can inadvertently be withdrawn from the drug vial 300 and into the main conduit 620.

During a normal aspiration process, air bubbles can typically be formed as the liquid medication is withdrawn through the cannula 520 and into the main conduit 620, which is typically in the form of tubing or the like. These air bubbles are merely by-products that can be formed during the aspiration process; however, they are not foreign matter that contaminates the aspirated drug that is to be delivered to a syringe for later use by a patient. Thus, the safety feature should be able to discern between the presence of air bubbles compared to the presence of unwanted foreign matter, such as undissolved drug particles and other particles, such as pieces of the septum, etc.

The safety feature is preferably incorporated into either the cannula 520 or into the main conduit 620. For example, one exemplary safety feature is in the form of a first sensor 700 that is associated with either the cannula 520 or the main conduit and is constructed so that it is capable of detecting any unwanted foreign matter that may have been withdrawn from the drug vial 300 as the medication is aspirated. In the exemplary embodiment, the sensor 700 is mounted to the cannula housing 510 such that when the cannula housing 510 is moved, the sensor 700 moves with it. For example, the sensor 700 itself can be attached to the cannula housing 510 via a bracket or the like that permits the sensor 700 to be positioned at the desired location relative to the conduit 620 where the meniscus of the aspirated medication will lie during normal operation. The sensor 700 should be able to differentiate an acceptable condition, such as the presence of air bubbles from an unacceptable condition, such as the presence of foreign matter, e.g., undissolved drug, small pieces of septum, etc.

One exemplary sensor 700 that forms a part of the safety feature is disposed around the main conduit 620. For example, the sensor 700 can be disposed exterior the main conduit 620 and adjacent the main conduit 620 or adjacent a fluid conduit that is part of the cannula 510 and fluidly connected to the main conduit 620. One type of sensor 700 is a photoelectric sensor that emits a light beam (visible or infrared) from its light-emitting element. There are several types of photoelectric sensors including a reflective type photoelectric sensor that is used to detect the light beam reflected from the target and a thrubeam type photoelectric sensor that is used to measure the change in light quantity caused by the target crossing the optical axis. More specifically, in the thrubeam type sensor, detection occurs when the target crosses the optical axis between a transmitter and a receiver. Some of the advantages of a thrubeam type sensor are: long-detecting distance; stable detecting position; opaque objects detectable regardless of shape, color or material; and it includes a powerful beam. In a diffuse-reflective type sensor, detection occurs when the light beam, emitted to the target, is reflected by the target and received. Some of the advantages of the diffuse-reflective type sensor are: it is a space-saving device (requires installation of sensor unit only); adjustment of optical axis is not required; reflective transparent objects are detectable; and color differentiation is possible. Other types of reflective sensors that are suitable for use include a definite-reflective sensor; a retro-reflective sensor, as well as any other type of sensor that is intended for detecting particles.

There are a number of different commercial suppliers for photoelectric sensors. A number of suitable photoelectric sensors are commercially available from Keyance Corporation. For example, one type of reflective sensor that is particularly suited for use in the present invention is commercially available under the trade name FU series sensors.

For example, the first sensor 700 can be configured so that light is directed into and through the main conduit 620 and the sensor 700 detects the presence of any particles by detecting any light beam reflected from the target, in this case a particle in the medication. The master controller of the present system is preferably configured so that when the first sensor detects that the light beam is reflected, a signal is generated and is delivered to the master controller which then further processes the signal to determine what operation should be taken. For example, if the light beam emitted from the sensor 700 strikes an object and is reflected back and received by the sensor unit, then the sensor 700 processes this as a detection of a foreign object (target) in the medication. In the event that the sensor 700 detects foreign matter, then the master controller can be configured to signal to the automated devices of the system that the medication within the main conduit 620 does not pass standards and therefore should be discarded, e.g., medication within the main conduit 620 can be discharged into a waste receptacle or the like.

It will also be appreciated that the master controller can be configured so that it is able to detect air bubbles that may be present in the main conduit when the medication is aspirated. In other words, a second sensor 710 can be configured and positioned near the main conduit 620 so that it detects and reflectance of the light beam due to the presence of air bubbles. In other words, a different second sensor 710 can be provided for the purpose of detecting air bubbles within the medication. Since air bubbles do not constitute unwanted foreign material, the first and second sensors 700, 710 and the master controller can be disposed around the main conduit 620 and integrated together so that a differentiation between air bubbles and solid particles can be made and therefore, if only air bubbles are present, the sensors send respective signals or no signals and the master controller reads and interprets the signals and will not instruct the automated device(s) to discard the aspirated medication since air bubbles are acceptable condition.

Figure 7:
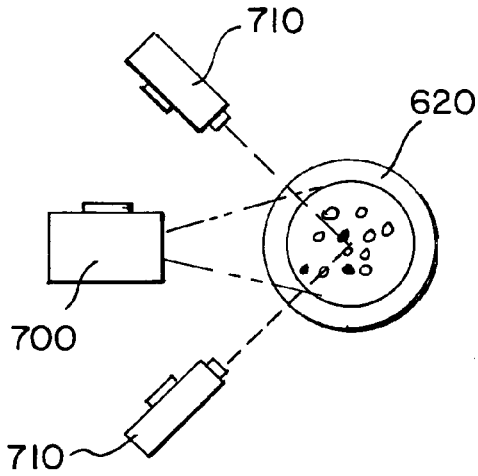
FIG. 7 is a cross-sectional view taken along the line 7—7 of FIG. 6.
Figure 8:
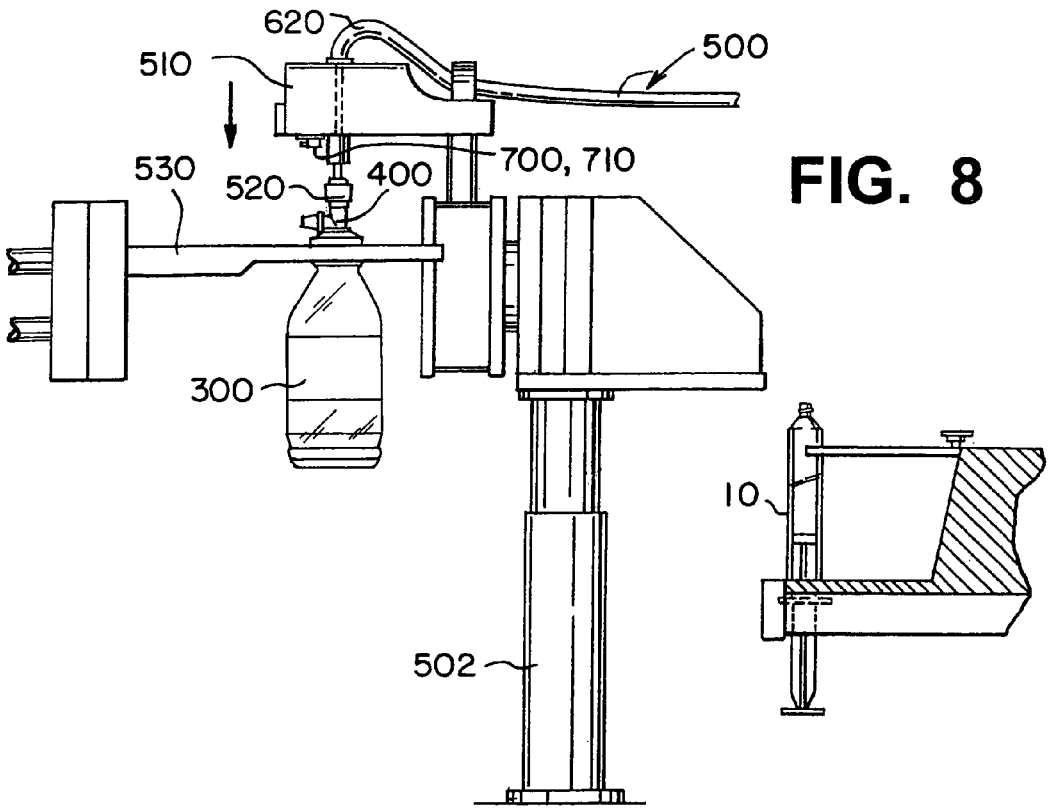
FIG. 8 is a side elevation view of the fluid delivery system in a second position in an extended position where it is in mating relationship with the drug vial.
Figure 9:
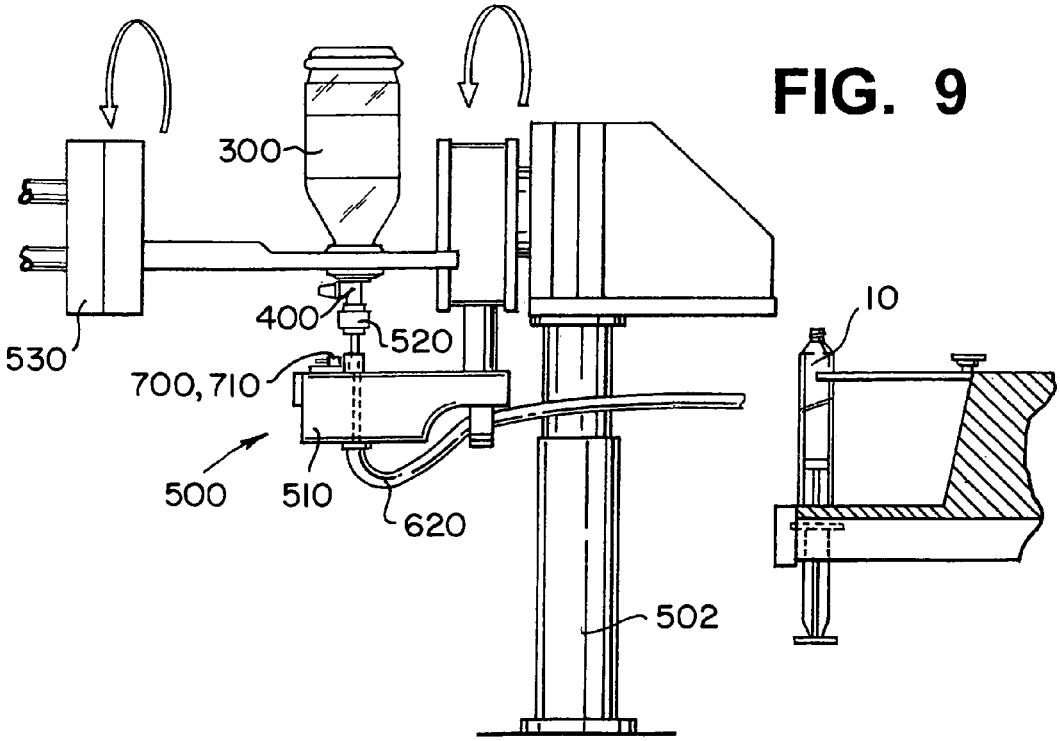
FIG. 9 is a side elevation view of the fluid delivery system in a third position in which the fluid delivery system and the vial gripper device are rotated to invert the fluid delivery system with the vial and permit aspiration of the contents of the vial.

For example, in one exemplary embodiment, the first sensor 700 is a diffuse-reflective sensor that is commercially available from Keyance Corporation under the trade name FU-66 which is a sensitive sensor that is capable of detecting small particles on the order of 50 micron. Due to the high sensitivity of the FU-66 sensor 700, it is capable of detecting both air bubbles and particles; however, it is not capable of differentiating between the two types of particles. More specifically and as a result of the high sensitivity, the readings of the FU-66 sensor can be corrupted by the presence of some air bubbles inside the drug. Although, the air bubble is transparent to the light, in some uncommon conditions and depending upon the shape of the bubble, it is possible for the FU-66 to give a positive error as if a particle (foreign matter) is present. In order to filter out these false detections, another fiber optic sensor (e.g., FU-95Z) is used along with the diffusive-reflective sensor (e.g., FU-66). The FU-95Z sensor is a definite-reflective sensor and is capable of sensing small bubbles. The FU-95Z is disposed alongside the other sensor FU-66 and the set-up of the two in combination enables the system to detect particles attached to air bubbles as well. As shown in FIG. 7, the second sensor 710 is arranged adjacent the first sensor 700 such that the emitted beam of the first sensor 70 is not detected by the second sensor 710 and vice versa. Thus, the exemplary second sensor 710 can be of the type shown in FIG. 7 and be formed of a light-emitting element and a light-receiving element that is arranged at a predetermine angle such that it is off-set therefrom. For example, the light-emitting element and the light-receiving element are off-set about 45 degrees from one another with the first sensor 700 being disposed between these two elements. Thus, any beam that is reflected off of an air bubble is received by the light-receiving element in its offset position. While this is one exemplary arrangement scheme between the first and second sensors 700, 710, it will be appreciated that there are a number of other arrangement that are possible so long as the false positives are not created due to light beams of one sensor being detected by the other sensor in the absence of any particles.

In order to detect the foreign matter that may have been aspirated, both of the sensors 700, 710 are preferably positioned at or very close to the meniscus of the aspirated drug that is contained within the main conduit 620. This is a preferred location since it is likely that the unwanted foreign material will settle to such a location after it has been aspirated into the main conduit 620. In addition, the air bubbles that may be present will likewise be found in the same region of the main conduit 620.

Accordingly, the optical sensor is thus capable of detecting foreign unwanted matter that is present within the main conduit 620 along with the aspirated medication by detecting that the reference light beam is reflected and then received by the sensor. It will be appreciated that in most typical situations, air bubbles will not obstruct or reflect the reference light beam since they are not opaque in nature and therefore, they permit the reference light beam to pass through without any reflection back to the sensor unit.

Thus, any solid matter, including undissolved drug or pieces of the septum 320, that is present in the medication can be detected as a result of the reflection of the reference beam. Once the sensor detects that the reference beam is being reflected by some object, the sensor signals the master controller to take the necessary steps. For example, the medication can be discarded by discharging the medication into a waste drain 800 or the like and then the medication preparation process can be repeated and another prescribed dosage of medication can be aspirated into the main conduit 620 as shown in FIG. 13.

It will also be understood that any number of other types of devices can be used as sensing devices so long as the sensors are capable of detecting the presence of unwanted solid foreign matter, such as undissolved solid drug or pieces of foreign material. Most of these sensors will employ some type of vision system that is capable of reading and determining whether opaque, foreign matter is present within the medication. For example, occlusion of a light beam can be detected as opposed to reflection thereof as described above.

Preferably, the sensor is disposed relative to the main conduit 620 so that the sensor monitors the condition of the meniscus of the aspirated medication, and more particularly, the sensor detects the presence of any foreign matter in the medication at the meniscus portion thereof. It will be appreciated that the sensor 700 can be moved and positioned relative to the main conduit 620 at a location other than the meniscus so that the sensor 700 can monitor for the presence of unwanted foreign matter in other locations along the main conduit 620.

While the detector has been at least partially described as being a sensor unit that is disposed around the main conduit 620, the sensor can come in other forms and be located in different locations depending upon the type of unit that is being used as a sensor. For example, the sensor can be in the form of a strip or the like that can be disposed around the main conduit 620. However, the location of the sensor unit should be controlled so that the emitted light beam does not strike a background and generate a false positive.

Accordingly, the sensor arrangement disclosed herein serves as a safety feature that is capable of detecting an undesirable condition, namely the presence of small solid particles in the aspirated unit dose of medication. By detecting this condition prior to delivery of the medication to the syringe, safety is ensured and cost savings result.

In yet another aspect, the detection system (e.g., sensors) can be linked to a communications network so that the detection system (or parts thereof) can be signaled from remote locations. For example, the sensor of the detection system can have a communications port that is in communication with a remote controller. An individual at a remote site can use the remote controller and signal any sensor to go offline. Conventional signal addressing protocol can be used so that the remote controller can be used to control a number of detection systems that are located in different places but all linked to the communications network. This permits the detection system to be by-passed when conditions require such action or for other reasons when it may be desirable to disable the detection system.

The present system and method for automating the medication preparation process and more specifically, the safety feature thereof serves as a cost reducing feature that is capable of detecting unwanted foreign matter that may be present in a unit dose of medication that is withdrawn from a drug vial. This not only increases safety patient since medication with potentially harmful foreign matter is not delivered to a patient but it also reduces the overall cost of the medication preparation system.

It will also be appreciated that while in one embodiment, the detection of foreign matter influences the handling of the unit dose of medication by instructing the system to prevent the delivery of the unit dose to the syringe, it is equally possible and preferred in many applications for the detection of foreign matter in the aspirated dose to influence the handling of the unit dose in a different manner. More specifically, after detecting the foreign matter, the unit dose is still delivered to the syringe; however, the system identifies and optionally marks the syringe as being one that requires further examination, e.g., visual inspection. For example, the syringe identified as requiring further examination can be removed from the rotary device 130 after filling thereof and then can be delivered to a location or station where visual inspection is performed. In other words, this station constitutes an area where a number of syringes can be delivered, all of which require visual inspection to determine if the foreign matter is within syringe and whether the syringe can be used or not.

What is claimed is:

1. An automated medication preparation system including automated syringe preparation including reconstitution of the medication and delivery of the reconstituted medication to a syringe, the system comprising:

an automated device for delivering a prescribed unit dose of medication to the syringe by injecting the medication through an uncapped barrel, wherein the automated device for delivering the unit dose of medication to the syringe comprises an automated device having a fluid delivery device that includes a main conduit, wherein the fluid delivery device is adapted to perform the following operations: (1) receiving and discharging diluent from a diluent supply in a prescribed amount to reconstitute the medication in a drug vial; and (2) aspirating the reconstituted medication into the main conduit and later discharging the reconstituted medication from the drug vial into the syringe; and a first sensor to detect foreign matter present in the reconstituted medication prior to transfer of the reconstituted medication to the syringe, and whereupon, if foreign matter is detected, then a detection signal is generated and optionally the reconstituted medication is prevented from being delivered to the syringe, wherein the main conduit of the fluid delivery device contains the reconstituted medication and the sensor is disposed around the main conduit for detecting the foreign matter before transfer to the syringe.

2. The automated system of claim 1, wherein the fluid delivery device is fluidly connected to the main conduit that is selectively connected at its opposite end to the diluent source and to a means for creating either negative pressure or positive within the main conduit for aspirating fluid into the main conduit or discharging fluid therefrom, respectively.

3. The automated system of claim 2, wherein the means comprises:

a collection member for storing diluent received from either the diluent source or diluent that is drawn into the collection member from a downstream section of the main conduit; and a control unit and a valve mechanism that are operatively connected to the collection member to create negative pressure therein to drawn fluid therein or to create positive pressure to force fluid to be discharged therefrom.

4. The automated system of claim 3, wherein the collection member comprises:

a first syringe having a barrel with an interior having a first volume; and a second syringe having a barrel with an interior having a second volume;

wherein each of the first and second syringes having a slideable plunger contained in the respective barrel and each syringe being in selective fluid communication with each of the diluent source and the main conduit that leads to the fluid delivery device.

5. The automated system of claim 4, wherein the first volume is at least 50% greater than the second volume.

6. The automated system of claim 4, wherein the control unit comprises:

a first syringe driver associated with the first syringe for selectively moving the plunger a prescribed distance;

a second syringe driver associated with the second syringe for selectively moving the plunger a prescribed distance; and the valve mechanism includes a first valve for providing selective fluid communication between the control unit and the diluent source and a second valve for providing selective fluid communication between the control unit and the downstream section of the main conduit.

7. The automated system of claim 6, wherein the first and second syringes are fluidly interconnected by a connector conduit that has a valve associated therewith for permitting selective flow between the syringes.

8. The automated system of claim 6, wherein at least one of the first and second syringes has an input port and an output port with the input port being connected to a first conduit that connects at its opposite end to the diluent source with a valve being associated with the first conduit to provide selective communication between the diluent source and the input port, the output port being connected to a second conduit that connects at its opposite end to the main conduit with a valve being associated with the second conduit to provide selective communication between the output port and the main conduit.

9. The automated system of claim 6, wherein each of the first and second syringe drivers comprises a stepper motor that operates such that an incremental distance of movement of the plunger is equated to a number of steps through which the motor is driven, thereby permitting precise control over the exact distance that the plunger is moved.

10. The automated system of claim 1, wherein the first sensor is a photoelectric sensor that detects any reflection of an emitted beam which is indicative of foreign matter being present in the aspirated medication that is contained within a fluid conduit that forms a part of the fluid delivery device.

11. The automated system of claim 10, wherein the first sensor includes a light-emitting element for producing the light beam and a light-receiving element for receiving any light beam that reflects off of the foreign matter, the first sensor generating and sending a signal to a master controller if the first sensor detects the foreign matter, the master controller being in communication with components of the system.

12. The automated system of claim 11, wherein the first sensor is part of a vision system that is operatively connected to the master controller and is configured to be able to differentiate between a presence of air bubbles in the medication and unwanted foreign matter, wherein if air bubbles are present in the medication, the master controller still instructs the unit dose of medication to be delivered to the syringe.

13. The automated system of claim 11, wherein the first sensor is a diffusive-reflective sensor that is configured to detect particles as small as 50 micron, the light-emitting element and the light-receiving element being contained within a single housing that is positioned facing a main conduit.

14. The automated system of claim 13, wherein the first sensor is configured and has a sensitivity such that it is capable of detecting air bubbles as well as the foreign matter in the form of solid particles.

15. The automated system of claim 1, wherein the foreign matter is an amount of undissolved medication or solid particles contained in the medication.

16. The automated system of claim 1, wherein the medication is aspirated into the main conduit that is a part of the fluid delivery device and the first sensor is constructed to transmit light through the main conduit and includes a detector for dectecting the beam after it passes through the main conduit such that any foreign material that is present in the main conduit occludes the light causing the detector to send a signal to the master controller indicating the presence of the foreign matter.

17. An automated medication preparation system including automated syringe preparation including reconstitution of the medication and delivery of the reconstituted medication to a medication delivery device, the system comprising:

an automated device for reconstituting and delivering a prescribed unit dose of reconstituted medication to the medication delivery device;

a first sensor to detect foreign matter present in the reconstituted medication prior to transfer of the reconstituted medication to the medication delivery device, and whereupon, if foreign matter is detected, then a detection signal is generated and optionally the reconstituted medication is prevented from being delivered to the medication delivery device; and a second sensor that comprises a photoelectric sensor that lacks sensitivity to detect minute particles but is capable of detecting air bubbles and generates a signal when air bubbles are detected.

18. The automated system of claim 17, wherein the second sensor comprises a definite-reflective sensor that is placed adjacent the first sensor exterior to a main conduit that receives the reconstituted medication.

19. The automated system of claim 17, wherein the first sensor comprises a diffusive-reflective sensor that is capable of detecting both air bubbles and solid particles and the second sensor in combination with the first sensor forms a filter to filer out false positives that can result if the first sensor detects air bubbles as opposed to solid particles such that if a master controller in communication with both sensors and receives signals from both the first and second sensors then the master controller filters out the false positive and the aspirated unit dose of medication is delivered to the syringe.

20. A method for automated preparation of a medication comprising the steps of:

providing a medication preparation device for reconstituting and delivering a prescribed unit dose of reconstituted medication through a main fluid conduit to a medication delivery device, mounting a first sensor to the medication preparation device such that the first sensor is movable with the medication preparation device, the first sensor being configured to detect foreign matter present in reconstituted medication contained within the main fluid conduit prior to transfer of the reconstituted medication to the medication delivery device;

focusing the first sensor on a meniscus region of the reconstituted medication;

detecting by means of the first sensor the presence of any foreign matter in the reconstituted medication located in the main fluid conduit, wherein the sensor is a reflective type sensor that detects light reflected by the foreign matter; and delivering the reconstituted medication to the medication delivery device if the reconstituted medication is free of foreign matter and whereupon, if foreign matter is detected, a signal is delivered to the fluid delivery device and the reconstituted medication is optionally prevented from being delivered to the medication delivery device.

21. The method of claim 20, wherein the step of delivering the reconstituted medication to the medication delivery device comprises the step of delivering the reconstituted medication to an uncapped barrel of a syringe.

22. The method of claim 20, further including the steps of:

receiving and discharging diluent from a diluent supply in a prescribed amount to reconstitute the medication in a drug vial; and aspirating the reconstituted medication from the drug vial into the main fluid conduit.

23. The method of claim 21, wherein the step of detecting the presence of foreign matter comprises the steps of:

disposing an optical sensor proximate to but exterior to the main fluid conduit;

emitting a light beam toward the medication contained in the main fluid conduit;

detecting whether the light beam is reflected as a result of contacting foreign matter that is contained in the medication in the main fluid conduit; and if the light beam is reflected, then the signal is delivered to the fluid delivery device and the reconstituted drug dosage is prevented from being delivered to the medication delivery device.

24. The method of claim 23, wherein the first sensor is a diffusive-reflective optical sensor and the step of detecting comprises the steps of:

emitting the light beam from a light-emitting beam that forms a part of a single sensor unit; and detecting any reflected light beam with a light-receiving element that is part of the single sensor unit that is placed adjacent the main fluid conduit.

25. The method of claim 20, further comprising the step of:

disposing a second sensor adjacent the first sensor and proximate the main fluid conduit, wherein the second sensor has a sensitivity that permits detection of air bubbles and not solid particles, emitting a light beam toward the medication contained in the main fluid conduit;

detecting whether the light beam is reflected and if so, generating an air bubble signal that is delivered to a master controller;

processing signals from one or both of the first and second sensors with the master controller such that if the first sensor detects reflection of its emitted light beam and the second sensor detects reflection of its emitted light beam, then the master controller determines the existence of a false positive and the reconstituted medication is delivered to the syringe.

26. The method of claim 20, wherein the fluid delivery device is in selective fluid communication with a fluid pump apparatus that is in selective fluid communication with a diluent source, the fluid pump apparatus having a first controllable syringe that is in fluid communication with the diluent source and with a second controllable syringe that is also in selective fluid communication with the medication preparation device through the main conduit which is primed, each of the syringes being operably connected to a drive that causes either a positive or negative pressure to exist in a barrel thereof, and the step of reconstituting the medication includes the steps of:

opening fluid communication between the diluent source and the first syringe and preventing fluid communication between the second syringe and the medication preparation device;

operating a drive of one of the first and second syringes to create a negative pressure therein resulting in a prescribed amount of diluent being drawn into a barrel thereof;

preventing fluid communication between the diluent source and the first syringe and allowing fluid communication between the second syringe and the medication preparation device;

operating the drive so as to discharge the prescribed amount of diluent from one of the first and second syringes into the primed main conduit resulting in the prescribed amount of diluent being discharged through the medication preparation device and into the vial;

agitating contents of the vial;

operating a drive of one of the first and second syringes to create a negative pressure therein resulting in the prescribed dosage amount of medication being aspirated into the main conduit with an air block separating the aspirated medication from the diluent in the main conduit due to a volume of diluent, which is equal to the prescribed dosage amount, be drawn into the syringe barrel;

positioning the medication preparation device within the syringe; and operating the drive of one of the first and second syringes to create a positive pressure therein resulting in the prescribed dosage amount of medication being discharged from the main fluid conduit into the syringe as a result of the volume of diluent being discharged from the syringe into the main conduit.

27. The method of claim 20, whereupon, if foreign matter is detected, then the system is instructed to deliver the reconstituted medication to the syringe and identify and optionally mark the syringe as requiring visual inspection.

28. The method of claim 27, further including the step of:

delivering the identified syringe to a separate station where visual inspection of the syringe can occur to determine whether the syringe is suitable for use.

29. A method for automated preparation of a unit dose of medication comprising the steps of:

providing an automated medication preparation device for reconstituting and delivering the unit dose of reconstituted medication through a main fluid conduit to a medication delivery device, wherein the medication preparation device is adapted to aspirate the reconstituted medication into the main fluid conduit after reconstitution thereof;

disposing a first sensor proximate the main fluid conduit to detect foreign matter present in the reconstituted medication contained in the main fluid conduit prior to transfer of the reconstituted medication to the medication delivery device;

aspirating the reconstituted medication into the main fluid conduit:

detecting by means of the first sensor the presence of any foreign matter in the reconstituted medication aspirated into the main fluid conduit;

differentiating between air bubbles and the foreign matter, wherein the first sensor only generates a signal instructing that the unit dose of medication be discarded if foreign matter is present in the medication as opposed to air bubbles; and delivering the reconstituted medication to the medication delivery device if the reconstituted medication is free of foreign matter and whereupon, if foreign matter is detected, a signal is delivered to the fluid delivery device and the reconstituted medication is optionally prevented from being delivered to the syringe.

30. A method for automated preparation of a unit dose of medication comprising the steps of:

providing an automated medication preparation device for reconstituting and delivering the unit dose of reconstituted medication through a main conduit to a medication delivery device;

disposing a first sensor proximate the main fluid conduit to detect foreign matter present in the reconstituted medication contained in the main fluid conduit prior to transfer of the reconstituted medication to the medication delivery device;

aspirating the reconstituted medication into the main fluid conduit;

detecting by means of the first sensor the presence of any foreign matter in the reconstituted medication that is aspirated into the main fluid conduit; and delivering the reconstituted medication to the medication delivery device if the reconstituted medication is free of foreign matter and whereupon, if foreign matter is detected, a signal is delivered to the fluid delivery device and the reconstituted medication is optionally prevented from being delivered to the syringe;

wherein the step of disposing the first sensor comprises the step of:

disposing the first sensor adjacent a meniscus of the medication in the main fluid conduit.

31. An automated medication preparation system including automated syringe preparation including reconstitution of the medication and delivery of the reconstituted medication to a medication delivery device, the system comprising:

an automated device for delivering a prescribed dose unit of medication to the medication delivery device, wherein the automated device for delivering the unit dose to the medication delivery device comprises an automated device having a fluid delivery device that is in communication with a master controller; and a sensor arrangement disposed proximate the main fluid conduit and including at least one sensor and is configured in combination with the master controller to be able to differentiate between a presence of air bubbles in the medication and unwanted foreign matter in the medication, the sensor arrangement being disposed adjacent a meniscus region of the medication in the main fluid conduit to detect the presence of any air bubbles and foreign matter in the meniscus region, wherein if air bubbles are present in the medication, the master controller instructs the unit dose of medication to be delivered to the medication delivery device, while if foreign matter is present in the medication, then the handling of the reconstituted medication is influenced.

* * * * *